US008602087B2

(12) United States Patent
Yang

(10) Patent No.: US 8,602,087 B2
(45) Date of Patent: Dec. 10, 2013

(54) DOUBLE FLOW-CIRCUIT HEAT EXCHANGE DEVICE FOR PERIODIC POSITIVE AND REVERSE DIRECTIONAL PUMPING

(76) Inventor: Tai-Her Yang, Dzan-Hwa (TW)

( * ) Notice: Subject to any disclaimer, the term of this patent is extended or adjusted under 35 U.S.C. 154(b) by 659 days.

(21) Appl. No.: 12/292,415

(22) Filed: Nov. 19, 2008

(65) Prior Publication Data

US 2010/0122805 A1 May 20, 2010

(51) Int. Cl.
*F28F 27/00* (2006.01)

(52) U.S. Cl.
USPC ..... 165/11.1; 165/200; 165/287; 165/299; 165/300; 165/104.31

(58) Field of Classification Search
USPC ..... 165/4, 8, 10, 11.1, 200, 201, 60, 165/104.31, 111, 115, 287, 299, 300
See application file for complete search history.

(56) References Cited

U.S. PATENT DOCUMENTS 2,952,993 A * 9/1960 Bosworth, Jr. ..... 62/271
3,372,870 A * 3/1968 Norris et al. ..... 236/13
4,108,617 A * 8/1978 Frantz ..... 96/114
4,350,429 A * 9/1982 Slavin ..... 137/554
4,477,396 A * 10/1984 Wilkinson ..... 165/60
4,594,855 A * 6/1986 Gunther ..... 165/60
4,700,550 A * 10/1987 Rhodes ..... 62/271
4,832,115 A * 5/1989 Albers et al. ..... 165/104.31
4,941,324 A * 7/1990 Peterson et al. ..... 62/271
4,982,782 A * 1/1991 Albers et al. ..... 165/111
5,020,335 A * 6/1991 Albers et al. ..... 165/115
5,123,481 A * 6/1992 Albers et al. ..... 165/111
6,138,470 A * 10/2000 Potnis et al. ..... 165/163
6,216,483 B1 * 4/2001 Potnis et al. ..... 62/94
6,911,121 B1 * 6/2005 Beckman ..... 165/115
7,037,358 B2 * 5/2006 Babicki et al. ..... 95/113
7,041,272 B2 * 5/2006 Keefer et al. ..... 422/211
RE39,288 E * 9/2006 Assaf ..... 62/271
7,160,367 B2 * 1/2007 Babicki et al. ..... 96/116
7,260,945 B2 * 8/2007 Landry ..... 62/271
7,389,646 B2 * 6/2008 Moffitt ..... 165/8
7,431,805 B2 * 10/2008 Beckman ..... 203/2
7,614,248 B2 * 11/2009 Lee et al. ..... 62/291
7,721,460 B2 * 5/2010 Albers et al. ..... 34/80
7,905,108 B2 * 3/2011 Ikegami et al. ..... 62/271
2002/0116935 A1 * 8/2002 Forkosh et al. ..... 62/271
2004/0060315 A1 * 4/2004 Dinnage et al. ..... 62/271

* cited by examiner

*Primary Examiner* — Ljiljana Ciric
(74) *Attorney, Agent, or Firm* — Bacon & Thomas, PLLC

(57) ABSTRACT

A double flow-circuit heat exchange device for periodic positive and reverse directional pumping, which has a bi-directional fluid pump. The bi-directional fluid pump produces positive pressure or negative pressure at fluid ports on two sides of the bi-directional heat exchange device to periodically pump the fluid in positive and reverse flowing directions. During operation of the periodically positive and reverse pumping, the directional flow of the fluid in first and second flow fluid circuits are maintained in different flowing directions.

11 Claims, 10 Drawing Sheets

DOUBLE FLOW-CIRCUIT HEAT EXCHANGE DEVICE FOR PERIODIC POSITIVE AND REVERSE DIRECTIONAL PUMPING

BACKGROUND OF THE INVENTION (a) Field of the Invention

The present invention improves the conventional heat exchange device by pumping fluids in different flowing directions in a double flow circuit heat exchanger. By controlling the periodic positive and reverse directional pumping, the temperature difference distribution can be improved between the fluid and the heat exchanger. Additionally, the heat can be further interposed or coated with permeation or absorbability type desiccant materials, or the heat exchanger itself can have a concurrent moisture absorbing function. Through the positive and reverse directional pumping of the fluids in the double flow-circuit heat exchanger and the heat exchanger being interposed or coated with desiccant material, and/or the heat exchanger itself has a concurrent moisture absorbing function, to dehumidification effect of total heat exchange function can result. Moreover, pumping fluids in different flowing directions also results in reducing dust accumulation or pollution production which results from fluids flowing in fixed flowing directions.

(b) Description of the Prior Art

For a conventional heat exchange device or total heat exchange device that pumps fluids in different flowing directions, the fluid flowing directions are normally fixed. Since the fluid flowing direction is fixed, the temperature difference distribution gradients between the thermal exchange fluids and the internal heat exchangers do not change. Furthermore, the fluids in different flowing directions have differences in humidity saturation degrees at the two flow inlet/outlet ends and sides of the heat exchanger.

SUMMARY OF THE INVENTION

The present invention discloses a conventional heat exchange device having pumps to pump fluids in different flowing directions. The double flow-circuit heat exchange device also comprises a control device to control the periodic positive and reverse directional pumping having one or more of the following functions, including:

1) periodically changing the fluid pumping direction of the two fluid circuits promoting heat exchange efficiency, which also changes the difference in temperature distribution at the two ends of the internal heat exchanger, to increase the temperature difference conditions beneficial for heat absorbing and release of the internal heat exchanger;

2) periodically controlling the fluid flowing rate, the flowing direction, or both to manipulate the humidity saturation degree at the two inlet and outlet ports and two sides of the heat exchanger for applications using the heat exchanger interposed or coated with permeation or absorbability type desiccant material, or the heat exchanger itself having concurrent moisture absorbing function, or in the application of the total heat exchange device with fluid piping being series connected with the moisture absorbing device, to promote the dehumidification effect;

3) controlling the exchanging fluid flowing rate, direction, or both based on the composition of the exchanging fluid detected by a gaseous or liquid fluid composition detecting device; and 4) discharging impurities or pollutants brought in by the fluid flowing in one direction in the double flow circuit thereby reducing the disadvantages of impurity accumulations in fixed flowing directions.

DESCRIPTION OF MAIN COMPONENT SYMBOLS

Figure 1:
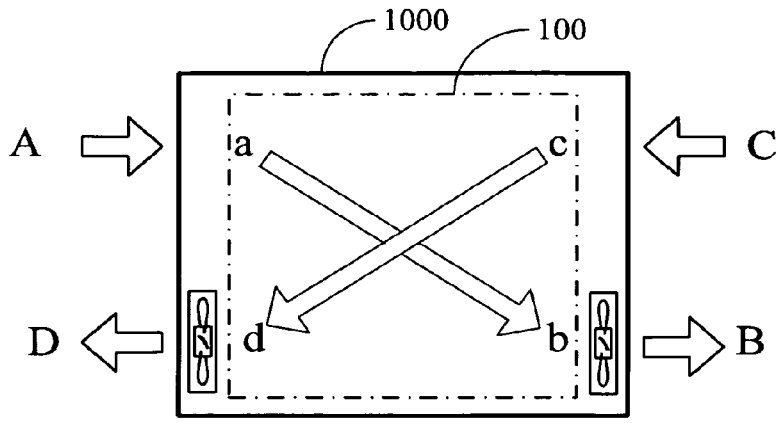
FIG. 1 (Prior Art)
FIG. 1 is a schematic view showing operating principles of the conventional bi-directional heat exchange device or total heat exchange device.

11: Temperature detecting device
21: Humidity detecting device
31: Gaseous or liquid fluid composition detecting device
100: Heat exchanger
111, 112, 113, 114: Bi-directional fluid pump
120, 120', 120*a*, 120*b*, 120*c*, 120*d*: Unidirectional fluid pumping device.
123: Bi-directional fluid pumping device
140: Bi-directional fluid pump
200: Total heat exchanger
250: Periodic fluid direction-change operative control device
300: Power source
1000: Heat Exchange device
a, b, c, d: fluid port

DETAILED DESCRIPTION OF THE PREFERRED EMBODIMENTS

FIG. 1 is a schematic view showing operating principles of the conventional bi-directional heat exchange device or total heat exchange device. As shown in FIG. 1, the conventional bi-directional heat exchange device or total heat exchange device has two fluid pumping devices to pump the fluids in different flowing directions and four fluid ports, wherein the four fluid ports correspond to two fluid circuits having a temperature difference. The two fluid circuits are pumped in different flowing directions to pass through the heat exchanger (100) inside the heat exchange device (1000) via the four fluid ports on the two sides. The two fluid circuits enter from first and second fluid ports on opposite sides and discharge from third and fourth fluid ports at the respective corresponding other side.

For example, a heat exchange device for indoor-outdoor air exchange in cold winter times has a pump that pumps the higher indoor temperature air flow through the heat exchange device (1000) via the first fluid port (a) and is discharged to the outdoors from the second fluid port (b) via a first fluid circuit at one side of the heat exchanger (100). In the other direction, a second fluid circuit having the lower temperature outdoor fresh air is pumped through the heat exchange device (1000) via the third fluid port (c) at another side and discharged indoors from the fourth fluid port (d) via the fluid circuit at the other side of the heat exchanger (100). The first fluid port (a) and the fourth fluid port (d) are disposed at the sides of the heat exchanger connected indoors while the third fluid port (c) and the second fluid port (b) are disposed outdoors.

The first fluid circuit has a temperature distribution between the first fluid port (a) and the second fluid port (b), wherein the first fluid port (a) has a higher temperature as compared to a lower temperature at the second fluid port (b). The second fluid circuit on the other side of the heat exchanger (100) has a temperature distribution wherein the temperature gradually rises to a higher temperature between the third fluid port (c) to the fourth fluid port (d). The efficiency of the heat exchange is determined by fluid property, fluid speed and the temperature difference of the fluids at the two sides of heat exchanger of the heat exchange device.

In the case of a heat exchanger that is interposed or coated with permeation or absorbability type desiccant material, or the heat exchanger itself is the total heat exchanger having concurrent moisture absorbing function, then the two fluid circuits in different flowing directions form temperature difference and humidity saturation degree difference at the two inlet and outlet ports and at the two sides of the heat exchanger device (1000).

Figure 2:
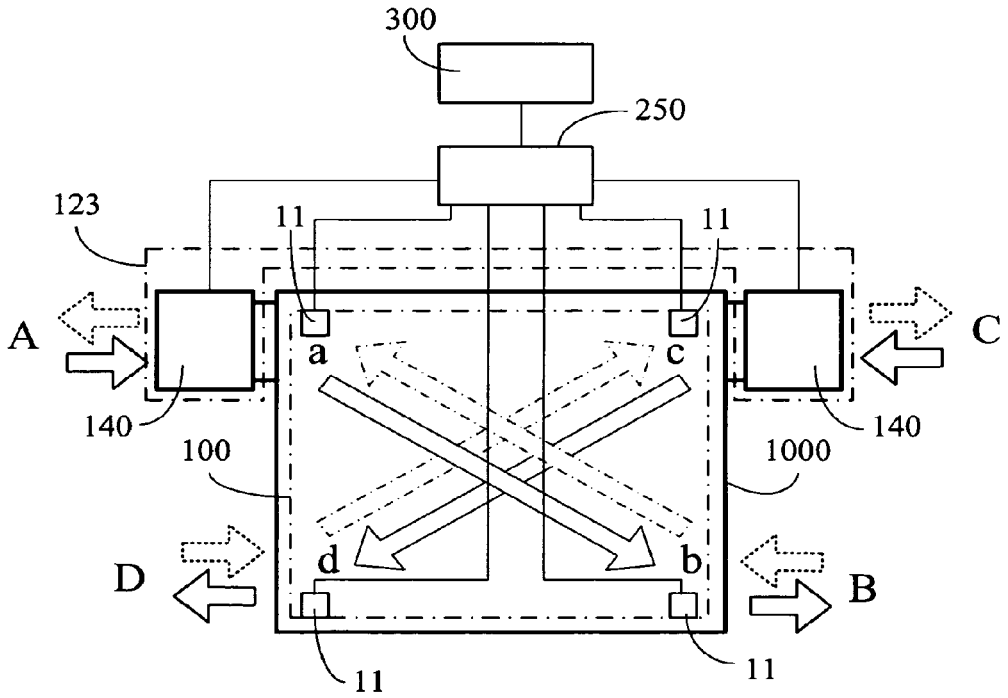
FIG. 2 is the first structural block schematic view of the embodiment showing the double flow-circuit heat exchange device for periodic positive and reverse directional pumping of the present invention being applied in the heat exchanger.

FIG. 2 is the first structural block schematic view of the embodiment showing the double flow-circuit heat exchange device for periodic positive and reverse directional pumping of the present invention being applied in the heat exchanger.

As shown in FIG. 2, the double flow-circuit heat exchange device for periodic positive and reverse directional pumping comprises a conventional bi-directional heat exchange device (1000) but is further installed with bi-directional fluid pumping device (123) which is capable of positive and reverse directional pumping by having at least two bi-directional fluid pumps (140). Additionally, the double flow-circuit heat exchange device is further installed with a fluid direction-change operative control device (250) for operatively controlling the bi-directional fluid pumping device (123) so as to periodically change the flowing directions of the pumping fluid. The operative control device (250) operates the two bi-directional fluid pumps of the bi-directional fluid pumping device (123) and is driven by power source (300). The fluids of the first and second fluid circuits are constantly maintained in two different flowing directions to pass through the heat exchanger (100).

The heat exchange device comprises two bi-directional fluid pumps capable of producing positive pressure to push fluids or negative pressure to attract fluids, to constitute a bi-directional fluid pumping device (123) for the application of pumping gaseous or liquid state fluids. Additionally, four fluid ports are installed at the heat exchange device (1000) to drive the bi-directional fluid pump (140) at the two sides of the heat exchanger (100) inside the heat exchange device (1000) by the electric power from power source (300) through the control of the periodic fluid directional-change operative control device (250). Furthermore, the flowing direction of the two fluid circuits are respectively fed or discharged from the fluid ports at different sides, and discharged or fed via the fluid port at the corresponding other side. In other words, a fluid is pumped into the heat exchanger (100) of the heat exchange device (1000) through the first fluid port (a), and passes through the first fluid circuit at one side of the heat exchanger (100) and is discharged outdoors via the second fluid port (b). A second fluid is pumped into the heat exchanger (100) of the heat exchange device (1000) through the third fluid port (c), and passes through the second fluid circuit at the other side of the heat exchanger (100) and is discharged outdoors via the fourth fluid port (d). Since the first fluid port (a) and the second fluid port (b) are used to connect the first fluid circuit, while the third fluid port (c) and the fourth fluid port (b) are used to connect the second fluid circuit, the flowing directions of the two fluid circuits can be periodically changed.

The heat exchange device further comprises a heat exchanger (100), which has two internal flow channels with heat absorbing/releasing capability. The two flow channels are individually set with two fluid ports for separately pumping the fluid and has a conventional heat exchange structure that allows heat exchanging between two fluids.

Additionally, at least one temperature detecting device (11) can be installed on the heat exchange device in a position capable of directly or indirectly detecting the temperature variation of the pumped fluid. The detected temperature signal can then be used as a reference to determine the timing for the periodic switching of the fluid flowing direction.

The bi-directional fluid pumping device (123) has two bi-directional pumps (140) capable of producing positive pressure to push fluid or negative pressure to attract fluid. The fluid can be pumped in opposite directions by the bi-directional pumps to constitute the bi-directional fluid pumping device (123) for pumping gaseous or liquid state fluids. The two fluid pumps can be respectively equipped with an electric motor or share a common electric motor, thereby being subject to the operative control of the periodic fluid direction-change operative control device (250) to rotate between a positive and reverse pressure to change the flowing direction of the pumping fluid. The fluid pumps are also capable of simultaneously pumping in opposite directions individually as well as periodically changing the pumping directions.

Additionally, said bi-directional fluid pumping device (123) and said heat exchange device (1000) can be arranged as an integral structure or as separated structures.

Power source (300) is connected to the heat exchange device to provide an operating power source, which includes a AC or DC power system or standalone electric power supplying devices.

The periodic fluid direction-change operative control device (250) comprises electromechanical components, solid state electronic components, or microprocessors with related software and control interfaces to operatively control the two bi-directional fluid pumps (140) inside the bi-directional fluid pumping device (123) for periodically changing the flowing direction of the two fluids in different flowing directions passing through the heat exchange device (1000), thereby operatively controlling the temperature distribution status between the fluids and the heat exchanger (100) of the heat exchange device (1000).

The control of the timing for the periodic fluid direction-change could be 1) an open-loop operation with pre-set periodic fluid direction changing timing; or 2) randomly manual switching; or 3) installing at least one temperature detecting device (11) at a position capable of directly or indirectly detecting the temperature variation of pumping fluid, wherein the detected signal is used as the reference to determine the periodic switching timing of fluid flowing direction change operation.

Figure 3:
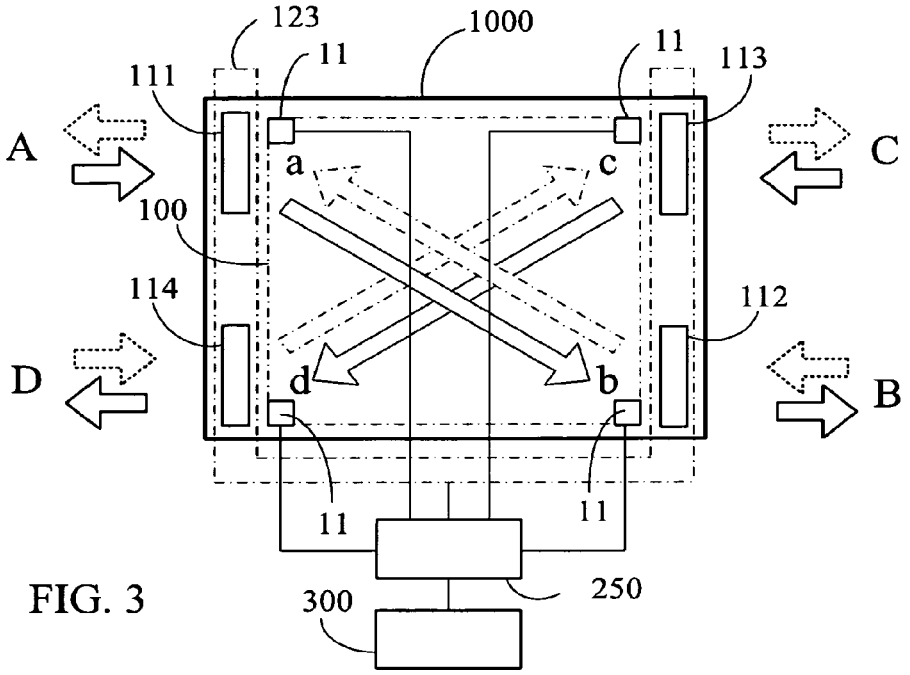
FIG. 3 is the second structural block schematic view of the embodiment showing the double flow-circuit heat exchange device for periodic positive and reverse directional pumping of the present invention being applied in the heat exchanger.

FIG. 3 is the second structural block schematic view of the embodiment showing the double flow-circuit heat exchange device for periodic positive and reverse directional pumping of the present invention being applied in the heat exchanger.

As shown in FIG. 3, the first fluid port (a), the second fluid port (b), the third fluid port (c), and the fourth fluid port (d) of bi-directional fluid in the heat exchange device (1000) are respectively installed with bi-directional fluid pumps (111), (112), (113), (114) which are capable of producing negative pressure or positive pressure constitutes the bi-directional fluid pumping device (123). The bi-directional fluid pumps (111), (112), (113), (114) are capable of producing negative pressure or positive pressure in the bi-directional fluid pumping device (123) and are driven by electric power source (300) to periodically change the flowing direction of the pumping fluid and constantly maintain the two fluid circuits which through the heat exchanger (100) flowing in different directions.

The heat exchange device (1000) and the bi-directional fluid pumps (111), (112), (113), (114) which are capable of producing negative pressure or positive pressure could be integrated as one device or the bi-directional fluid pumps can be separately installed to constitute the function of bi-directional fluid pumping device (123). Additionally, the four bi-directional fluid pumps (111), (112), (113), (114) which are capable of producing negative pressure or positive pressure can be separately installed at first fluid port (a), second fluid port (b), third fluid port (c) and fourth fluid port (d) for generating the pumping to change fluids in different flowing directions. The aforementioned bi-directional fluid pumps (111), (112), (113), (114) which are capable of producing negative pressure or positive pressure are controlled by the periodic fluid direction-change operative control device (250). The fluid pumps (111) and (113) that are installed at first fluid port (a) and third fluid port (c) form one set, which can be driven by individually installed electric motors, or jointly driven by single electric motor, while the fluid pumps (112) and (114) form another set and can also be driven by individually installed electric motors, or jointly driven by single electric motor. The periodic fluid direction-change operative control device (250) can be controlled to provide one or multiple of the following operating functions, including: 1) the partial control of the bi-directional fluid pumps to alternately pump periodically in negative pressure to allow the two fluid circuits in different flowing directions to change flowing directions; or 2) the partial control of the bi-directional fluid pumps to alternately pump periodically in positive pressure to allow the two fluid circuits in different flowing to change flowing directions; 3) the partial or full control of the bi-directional fluid pumps to form auxiliary pumping by the positive pressure pumping and negative pressure pumping generated by different fluid pumps in the same fluid circuits, thereby allowing two fluid circuits in different flowing directions to periodically change flowing direction. In the aforementioned functions, the flowing direction of the fluid inside the two channels at both sides of the heat exchanger (100) in the heat exchange device (1000) maintains opposite flowing directions.

Furthermore, the at least one temperature detecting device (11) can be installed at a position capable of directly or indirectly detecting the temperature variation of pumping fluid, wherein the detected signal is used as the reference to determine the periodic switch timing of the fluid flowing direction change operation.

Bi-directional fluid pumping device (123) comprises bi-directional first fluid port (a), second fluid port (b), third fluid port (c), and fourth fluid port (d) which are individually installed with bi-directional fluid pumps (111), (112), (113), (114) capable of producing negative pressure or positive pressure. The periodic fluid direction-change operative control device (250) operatively controls the bi-directional fluid pumping device (123) which is driven by electric power source (300) to periodically change the fluid direction changing operation, and constantly maintain the two fluid circuits which flow through the heat exchanger (100) in different directions.

The power source (300) provides the operating power source, including AC or DC city power or acts as a standalone electric power supplying devices.

The periodic fluid direction-change operative control device (250) comprises electromechanical components, solid state electronic components, or microprocessors with related software and control interfaces to operatively control the individual bi-directional fluid pumps (111), (112), (113), (114) that constitute the bi-directional fluid pumping device (123). The periodic fluid direction changing operation of the two different fluids flowing through the heat exchange device is controlled so that the temperature distribution status between the fluid and the heat exchanger (100) of the heat exchange device is controlled.

The heat exchanger (100) has two internal flow channels with heat absorbing/releasing capability. The two internal flow channels are individually set with two fluid ports at both sides to separately pump fluids and has a conventional heat exchange structure for the function of heat exchanging between two fluids.

The timing of periodic fluid direction-change can be controlled as: 1) an open-loop operation with pre-set periodic fluid direction changing timing; or 2) randomly manual switching; or 3) installing at least one temperature detecting device (11) at a position capable of directly or indirectly detecting the temperature variation of pumping fluid, so that the detected signal is used as the reference to determine the periodic switching timing of fluid flowing direction change operation.

Figure 4:
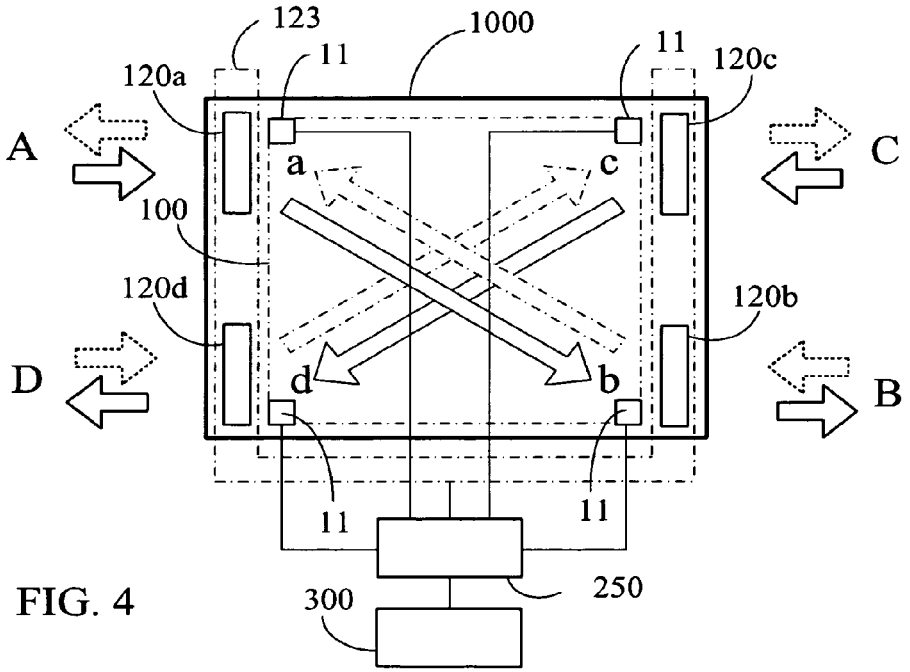
FIG. 4 is the third structural block schematic view of the embodiment showing the double flow-circuit heat exchange device for periodic positive and reverse directional pumping of the present invention being applied in the heat exchanger.

FIG. 4 is the third structural block schematic view of an embodiment of the invention showing the double flow-circuit heat exchange device for periodic positive and reverse directional pumping in the heat exchanger.

As shown in FIG. 4, the first fluid port (a), the second fluid port (b), the third fluid port (c), the fourth fluid port (d) of the two flow channels of the two bi-directional fluid of the heat exchanging device (1000) have the unidirectional fluid pumps (120*a*), (120*b*), (120*c*), (120*d*) separately installed for the unidirectional pumping that constitute the bi-directional fluid pumping device (123). The unidirectional fluid pumps are supplied with electrical power from the electrical power source (300) through the periodic fluid direction-change operative control device (250) to control the unidirectional pumps (120*a*), (120*b*), (120*c*), (120*d*) of the bi-directional fluid pumping device (123) to periodical change the flowing direction of the pumping fluid, and to constantly maintain the fluid flowing directions of both circuits passing through the heat exchanger (100) in different direction.

In this embodiment, the heat exchanging device (1000) and unidirectional fluid pumps (120*a*), (120*b*), (120*c*), (120*d*) can be integrated as one device or separately installed to constitute the function of bi-directional fluid pumping device (123), wherein the four unidirectional fluid pumps (120*a*), (120*b*), (120*c*), (120*d*) are separately installed at first fluid port (a), second fluid port (b), third fluid port (c) and fourth fluid port (d) for fluid pumping, and wherein the aforementioned unidirectional fluid pumps (120*a*), (120*b*), (120*c*), (120*d*) are controlled by the periodic fluid direction-change operative control device (250). The unidirectional fluid pumps (120*a*) and (120*c*) are installed at first fluid port (a) and third fluid port (c) to form one set of pumps, which can be driven by individually installed electric motors, or jointly driven by single electric motor. The other unidirectional fluid pumps (120*b*) and (120*c*) form another set of pumps, which can be driven by individually installed electric motors, or jointly driven by single electric motor. Under the control of periodic fluid direction-change operative control device (250) one or multiple of the following functions can be provided, including: 1) the arrangement of unidirectional pumps for negative pressure pumping on fluids, wherein the unidirectional fluid pump (120*a*) and unidirectional fluid pump (120*c*) form one set, and the unidirectional fluid pump (120*b*) and unidirectional fluid pump (120*d*) form the other set, so that the two sets alternately provide periodic negative pressure pumping to make the fluids flow in different flowing directions in the two channels and changing their flowing direction periodically; or 2) the arrangement of unidirectional pumps for positive pressure pumping on fluids, wherein the unidirectional fluid pump (120*a*) and unidirectional fluid pump (120*c*) form one set, and the unidirectional fluid pump (120*b*) and unidirectional fluid pump (120*d*) form the other set, so that the two sets alternately provide periodic positive pressure pumping to make the fluids flow in different flowing directions in the two channels and changing their flowing direction periodically.

In the aforementioned two functions, the flowing direction of the fluid inside the two channels at both sides of the heat exchanger (100) in the heat exchange device (1000) maintains opposite flowing directions.

The at least one temperature detecting device (11) can be installed at a position capable of directly or indirectly detecting the temperature variation of pumping fluid, wherein the detected signal is used as the reference to determine the periodic switch timing of the fluid flowing direction change operation.

Bi-directional fluid pumping device (123) comprises bi-directional first fluid port (a), second fluid port (b), third fluid port (c), and fourth fluid port (d) which are individually installed with unidirectional fluid pumps (120*a*), (120*b*), (120*c*), (120*d*) capable of unidirectional pumping to constitute the bi-directional fluid pumping device (123). The periodic fluid direction-change operative control device (250) operatively controls the bi-directional fluid pumping device (123) which is driven by electric power source (300) to periodically change the fluid direction changing operation, and constantly maintain the two fluid circuits which flow through the heat exchanger (100) in different directions.

The power source (300) provides the operating power source, including AC or DC city power or acts as standalone electric power supplying devices.

The periodic fluid direction-change operative control device (250) comprises electromechanical components, solid state electronic components, or microprocessors with related software and control interfaces to operatively control individual unidirectional fluid pumps (120*a*), (120*b*), (120*c*), (120*d*) that constitute the bi-directional fluid pumping device (123). The periodic fluid direction changing operation controls the different flowing direction of the fluids through the two channels of the heat exchanger (100), thereby operatively controlling the temperature distribution status between the fluid and the heat exchanger (100) of the heat exchange device (1000).

The heat exchanger (100) has two internal flow channels with heat absorbing/releasing capability, wherein the two flow channels are individually set with two fluid ports at both sides for separately pumping fluids and has a conventional heat exchange structure for the function of heat exchanging between two fluids.

The timing of the periodic fluid direction-change operation can be by: 1) open-loop operation with pre-set periodic fluid direction changing timing; or 2) randomly manual switching; or 3) installing at least one temperature detecting device (11) at a position capable of directly or indirectly detecting the temperature variation of pumping fluid, wherein the detected signal is used as the reference to determine the periodic switching timing of fluid flowing direction change operation.

Figure 5:
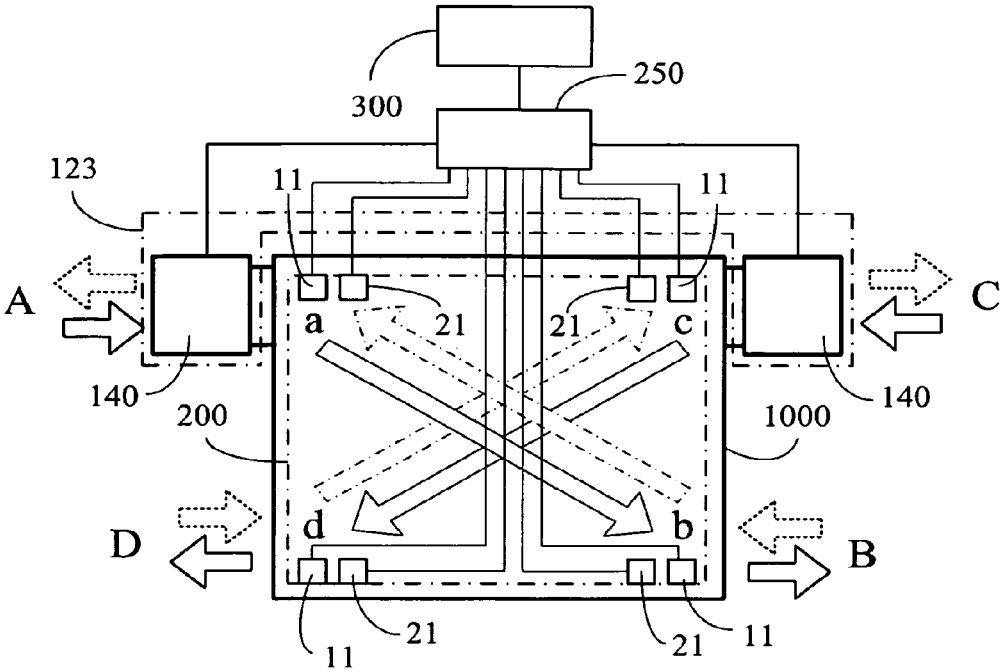
FIG. 5 is the first structural block schematic view of the embodiment showing the double flow-circuit heat exchange device for periodic positive and reverse directional pumping of the present invention being applied in the total heat exchanger.

FIG. 5 is the first structural block schematic view of the embodiment showing the double flow-circuit heat exchange device for periodic positive and reverse directional pumping of the present invention being applied in the total heat exchanger.

As shown in FIG. 5, the conventional bi-directional heat exchange device (1000) can be further installed with the bi-directional fluid pumping device (123) capable of positive and reverse directional pumping having two bi-directional fluid pumps (140), and installed with the periodic fluid direction-change operative control device (250) for operatively controlling the bi-directional fluid pumping device (123) to allow the two different direction fluids to periodically change the flowing directions that is operated with the two bi-directional fluid pumps (140) driven by power source (300). The two fluid circuits are constantly maintained in two different flowing directions to pass through the total heat exchanger (200) inside the heat exchange device (1000).

In this embodiment both or either one of the at least one temperature detecting device (11) and the at least one humidity detecting device (21) can be installed at positions capable of directly or indirectly detecting the temperature variation and humidity variation of the pumping fluid, wherein the detected signals are used as the reference to determine the periodic switch timing for the fluid flowing direction change operation. The aforementioned temperature detecting device (11) and humidity detecting device (21) can be in an integral structure or in separated structures.

Here the bi-directional fluid pumping device (123) comprises two bi-directional pumps (140) capable of producing positive pressure to push fluid or negative pressure to attract fluid in opposite directions to constitute the bi-directional fluid pumping device (123) for pumping gaseous or liquid state fluids. The two fluid pumps pump in opposite directions and can be separately equipped with an electric motor or share a common electric motor, thereby being subject to the operative control of the periodic fluid direction-change operative control device (250) to rotate positively or reversely to change the flowing direction of the pumping fluid. The fluid pumps can be capable of simultaneously pumping in opposite directions individually as well as periodically changing the pumping directions.

The above pumping methods include 1) producing negative pressure to push the fluid; or 2) producing positive pressure to attract the fluid. Additionally, the bi-directional fluid pumping device (123) and said heat exchange device (1000) can be installed as an integral structure or as separated structures.

Power source (300) is also provided as the operating power source, including AC or DC city power or acts as standalone electric power supplying devices.

The periodic fluid direction-change operative control device (250) comprises electromechanical components, solid state electronic components, or microprocessors with related software and control interfaces to operatively control the two bi-directional fluid pumps (140) inside the bi-directional fluid pumping device (123) for periodically changing the flowing direction of the two fluids in different flowing directions flowing through the heat exchange device (1000), thereby operatively controlling 1) the temperature distribution status; or 2) the humidity distribution status; or 3) both of the temperature and humidity distribution between the fluid and the total heat exchanger (200) of the heat exchange device (1000).

Total heat exchanger (200) has two internal flow channels with heat absorbing/releasing and humidity absorbing/releasing capability, wherein the two flow channels are individually set with two fluid ports at both sides for separately fluid pumping and is constituted by conventional total heat exchange structure for the function of heat exchanging between two fluids and function of de-humid capability.

The timing of the periodic direction change of the flowing fluid can be by: 1) an open-loop operation with pre-set periodic fluid direction changing timing; or 2) randomly manual switching; or 3) installing both or either one of the at least one temperature detecting device (11) and the at least one humidity detecting device (21) at positions capable of directly or indirectly detecting the temperature variation and humidity variation of pumping fluid, wherein the detected signals are used as the reference to determine the periodic switch timing of fluid flowing direction change operation.

Figure 6:
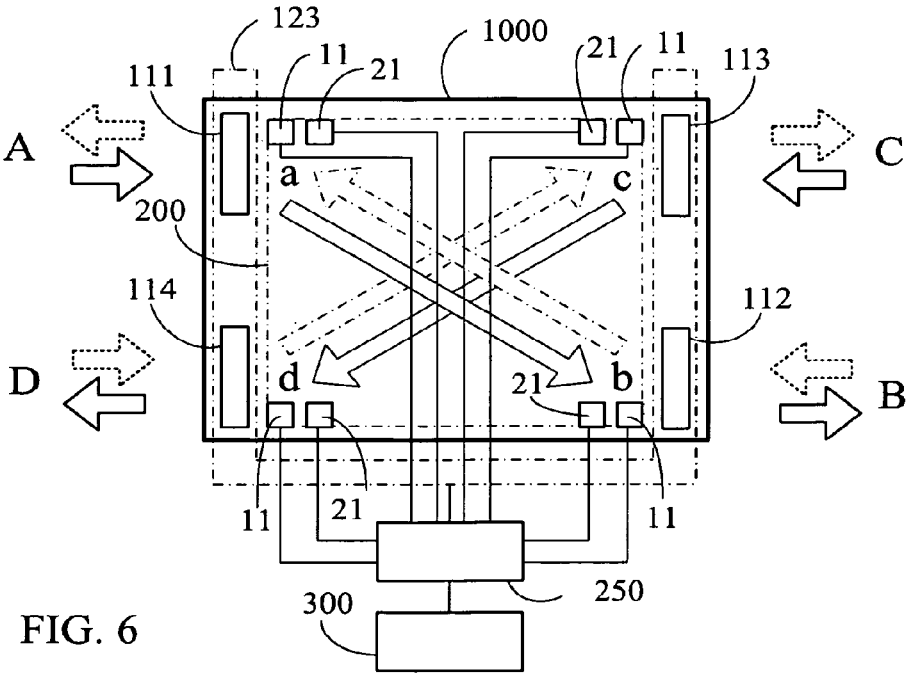
FIG. 6 is the second structural block schematic view of the embodiment showing the double flow-circuit heat exchange device for periodic positive and reverse directional pumping of the present invention being applied in the total heat exchanger.

FIG. 6 is the second structural block schematic view of the embodiment showing the double flow-circuit heat exchange device for periodic positive and reverse directional pumping of the present invention being applied in the full heat exchanger.

As shown in FIG. 6, the first fluid port (a), second fluid port (b), third fluid port (c), and fourth fluid port (d) of bi-directional fluid heat exchange device (1000) are respectively installed with bi-directional fluid pumps (111), (112), (113), (114) which are capable of producing negative pressure or positive pressure to constitute the bi-directional fluid pumping device (123). The bi-directional fluid pumps (111), (112), (113), (114) are capable of producing negative pressure or positive pressure in the bi-directional fluid pumping device (123) driven by electric power source (300) through the periodic fluid direction-change operative control device (250) to periodically change the flowing direction of the pumping fluid and constantly maintain the two fluid circuits flowing in different directions.

The heat exchange device (1000) and the bi-directional fluid pumps (111), (112), (113), (114) which are capable of producing negative pressure or positive pressure can be integrated in one device or separately installed to constitute the function of the bi-directional fluid pumping device (123). The four bi-directional fluid pumps (111), (112), (113), (114) are separately installed at first fluid port (a), second fluid port (b), third fluid port (c) and fourth fluid port (d) for generating the pumping to change the fluids to different flowing directions. Additionally, the aforementioned bi-directional fluid pumps (111), (112), (113), (114) are controlled by the periodic fluid direction-change operative control device (250). The fluid pumps (111) and (113) can be installed at first fluid port (a) and third fluid port (c) to form one set of pumps, which could be driven by individually installed electric motors, or jointly driven by single electric motor, while the fluid pumps (112) and (114) form another set, which could be driven by individually installed electric motors, or jointly driven by single electric motor, under the control of periodic fluid direction-change operative control device (250). The periodic fluid direction-change operative control device (250) is controlled to provide one or multiple following operating functions, including: 1) partial control of the bi-directional fluid pumps so that the pumps alternately pump in negative pressure to allow the two fluid circuits in different flowing directions to periodically flow in changing directions; or 2) partial control of the bi-directional fluid pumps to alternately pump in positive pressure periodically to allow the two fluid circuits flowing in different flowing directions to periodically change flowing directions; 3) partial or all of the bi-directional fluid pumps forming auxiliary pumping by the positive pressure pumping and negative pressure pumping generated by different fluid pumps in the same fluid circuits, thereby allowing two fluid circuits in different flowing directions to periodically change flowing direction. In the aforementioned functions, the flowing direction of the fluid inside the two channels at both sides of the total heat exchanger (200) in the heat exchange device (1000) maintains opposite flowing directions.

Both or either one of the at least one temperature detecting device (11) and the at least one humidity detecting device (21) are installed at positions capable of directly or indirectly detecting the temperature variation and humidity variation of pumping fluid, wherein the detected signals are used as the reference to determine the periodic switch timing of fluid flowing direction change operation. The aforementioned temperature detecting device (11) and humidity detecting device (21) can be in installed as an integral structure or as separated structures.

Bi-directional fluid pumping device (123) comprises first fluid port (a), second fluid port (b), third fluid port (c), and fourth fluid port (d) and are individually installed with bi-directional fluid pumps (111), (112), (113), (114) capable of producing positive pressures or negative pressure, thereby to constitute the bi-directional fluid pumping device (123). The periodic fluid direction-change operative control device (250) operatively controls the bi-directional fluid pumping device (123) which is driven by electric power source (300) for periodic fluid direction changing operation, and constantly maintains the two fluid circuits flowing in different direction;

The power source (300) provides the operating power source, including AC or DC city power or acts as standalone electric power supplying devices.

The periodic fluid direction-change operative control device (250) comprises electromechanical components, solid state electronic components, or microprocessors with related software and control interfaces to operatively control the bi-directional fluid pumps (111), (112), (113), (114) capable of producing negative pressure or positive pressure to constitute the bi-directional fluid pumping device (123), for the periodic fluid direction changing operation of the two different direction fluid through the two channels of the heat exchanging device to control 1) the temperature distribution status; or 2) the humidity distribution status; or 3) both of the temperature and humidity distribution between the fluid and the total heat exchanger (200) of the heat exchange device.

Total heat exchanger (200) has two internal flow channels with heat absorbing/releasing and humidity absorbing/releasing capability, wherein the two flow channels are individually set with two fluid ports at both sides for separately pumping fluid and has a conventional total heat exchange structure for the function of heat exchanging between two fluids and function of de-humid capability.

The timing of periodic direction change of flowing fluid can be controlled as: 1) an open-loop operation with pre-set periodic fluid direction changing timing; or 2) randomly manual switching; or 3) installing both or either one of the at least one temperature detecting device (11) and the at least one humidity detecting device (21) at positions capable of directly or indirectly detecting the temperature variation and humidity variation of pumping fluid, wherein the detected signals are used as the reference to determine the periodic switch timing of fluid flowing direction change operation.

Figure 7:
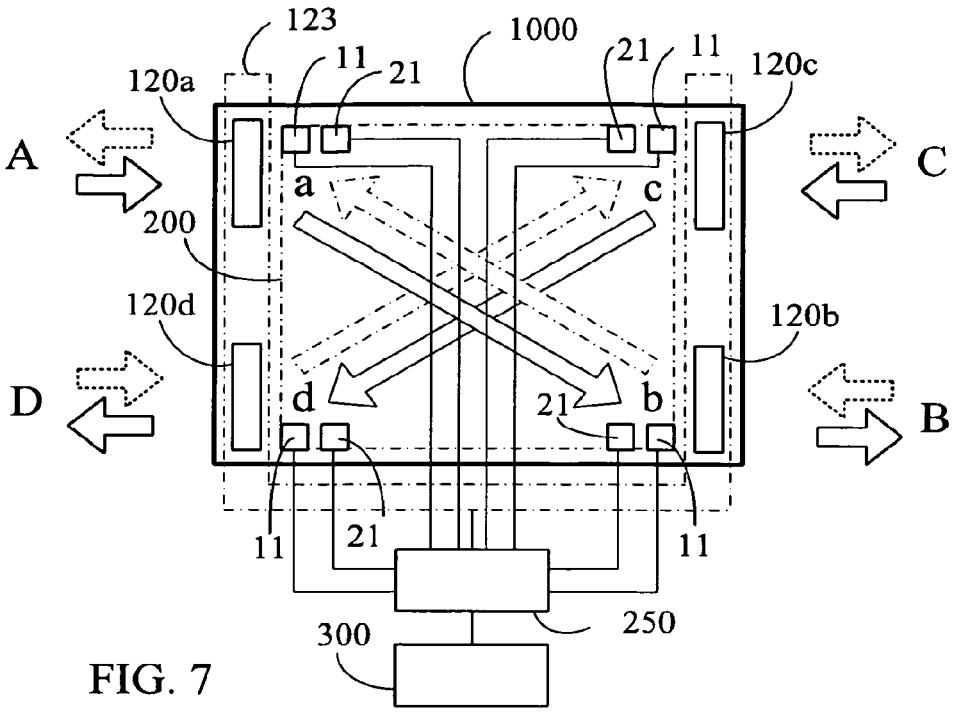
FIG. 7 is the third structural block schematic view of the embodiment showing the double flow-circuit heat exchange device for periodic positive and reverse directional pumping of the present invention being applied in the total heat exchanger.

FIG. 7 is the third structural block schematic view of the embodiment showing the double flow-circuit heat exchange device for periodic positive and reverse directional pumping of the present invention being applied in the full heat exchanger.

As shown in FIG. 7, the first fluid port (a), second fluid port (b), third fluid port (c), and fourth fluid port (d) of the two flow channels of the two bi-directional fluid of heat exchanging device (1000) of the present invention are separately installed with the unidirectional fluid pumps (120*a*), (120*b*), (120*c*), (120*d*) for unidirectional pumping to constitute the bi-directional fluid pumping device (123). The electrical power is supplied from the electrical power source (300) through the periodic fluid direction-change operative control device (250) to control the unidirectional pumps (120*a*), (120*b*), (120*c*), (120*d*) of the bi-directional fluid pumping device (123) to periodically change the flowing direction of the pumping fluid, and to constantly maintain the fluid flowing directions of both circuits in different directions.

In this embodiment, the heat exchanging device (1000) and unidirectional fluid pumps (120*a*), (120*b*), (120*c*), (120*d*) can be integrated as one device or separately installed to constitute the function of bi-directional fluid pumping device (123), wherein the four unidirectional fluid pumps (120*a*), (120*b*), (120*c*), (120*d*) are separately installed at first fluid port (a), second fluid port (b), third fluid port (c) and fourth fluid port (d) for fluid pumping, and wherein the aforementioned unidirectional fluid pumps (120*a*), (120*b*), (120*c*), (120*d*) are controlled by the periodic fluid direction-change operative control device (250). The unidirectional fluid pumps (120*a*) and (120*c*) are installed at first fluid port (a) and third fluid port (c) to form one set of pumps, which can be driven by individually installed electric motors, or jointly driven by single electric motor, while the unidirectional fluid pumps (120*b*) and (120*c*) form another set, which could be driven by individually installed electric motors, or jointly driven by single electric motor.

Under the control of periodic fluid direction-change operative control device (250) one or multiple of the following functions can be provided, including:

1) The arrangement of unidirectional pumps for negative pressure pumping on fluids, wherein the unidirectional fluid pump (120*a*) and unidirectional fluid pump (120*c*) form one set, and the unidirectional fluid pump (120*b*) and unidirectional fluid pump (120*d*) form the other set, and that the two sets provide periodic negative pressure pumping alternately making the fluids with different flowing direction change their flowing direction periodically; or
2) The arrangement of unidirectional pumps for positive pressure pumping on fluids, wherein the unidirectional fluid pump (120*a*) and unidirectional fluid pump (120*c*) form one set, and the unidirectional fluid pump (120*b*) and unidirectional fluid pump (120*d*) form the other set, and that the two sets provide periodic positive pressure pumping alternately making the fluids with different flowing direction change their flowing direction periodically.

In the aforementioned functions, the flowing direction of the fluid inside the two channels at both sides of total heat exchanger (200) in the heat exchange device (1000) maintains opposite flowing directions.

Both or either one of the at least one temperature detecting device (11) and the at least one humidity detecting device (21) are installed at positions capable of directly or indirectly detecting the temperature variation and humidity variation of pumping fluid, wherein the detected signals are used as the reference to determine the periodic switch timing of fluid flowing direction change operation.

Aforementioned temperature detecting device (11) and humidity detecting device (21) can be in an integral structure or in separated structures.

Bi-directional fluid pumping device (123) comprises first fluid port (a), second fluid port (b), third fluid port (c), and fourth fluid port (d) and are individually installed with bi-directional fluid pumps (111), (112), (113), (114) capable of producing positive pressures or negative pressure, thereby to constitute the bi-directional fluid pumping device (123). The periodic fluid direction-change operative control device (250) operatively controls the bi-directional fluid pumping device (123) which is driven by electric power source (300) for periodic fluid direction changing operation, and constantly maintains the two fluid circuits flowing in different directions.

The power source (300) provides the operating power source, including AC or DC city power or acts as standalone electric power supplying devices.

The periodic fluid direction-change operative control device (250) comprises electromechanical components, solid state electronic components, or microprocessors with related software and control interfaces to operatively control individual unidirectional fluid pumps (120*a*), (120*b*), (120*c*), (120*d*) that constitute the bi-directional fluid pumping device (123), for the periodic fluid direction changing operation of the two different direction fluid through the two channels of the heat exchange device to control 1) the temperature distribution status; or 2) the humidity distribution status; or 3) both of the temperature and humidity distribution between the fluid and the total heat exchanger (200) of the heat exchange device.

Total heat exchanger (200) has two internal flow channels with heat absorbing/releasing and humidity absorbing/releasing capability, wherein the two flow channels are individually set with two fluid ports at both sides for separately pumping fluid and has a conventional total heat exchange structure for the function of heat exchanging between two fluids and function of de-humid capability.

The timing of periodic direction change of flowing fluid can be controlled as: 1) an open-loop operation with pre-set periodic fluid direction changing timing; or 2) randomly manual switching; or 3) installing both or either one of the at least one temperature detecting device (11) and the at least one humidity detecting device (21) at positions capable of directly or indirectly detecting the temperature variation and humidity variation of pumping fluid, wherein the detected signals are used as the reference to determine the periodic switch timing of fluid flowing direction change operation.

The heat exchanger or total heat exchanger of the double flow-circuit heat exchange device for periodic positive and reverse directional pumping can have the following structural configurations: 1) a tubular structure in linear or other geometric shapes; or 2) a multi-layer structure having fluid path for passing gaseous or liquid state fluids; or 3) one or more than one flow circuit in series connection, parallel connection or series and parallel connection.

A comparison of a traditional heat exchange device and the present invention, that is the double flow-circuit heat exchange device for periodic positive and reverse directional pumping, is shown in FIG. 8, FIG. 9, FIG. 10 and FIG. 11.

Figure 8:
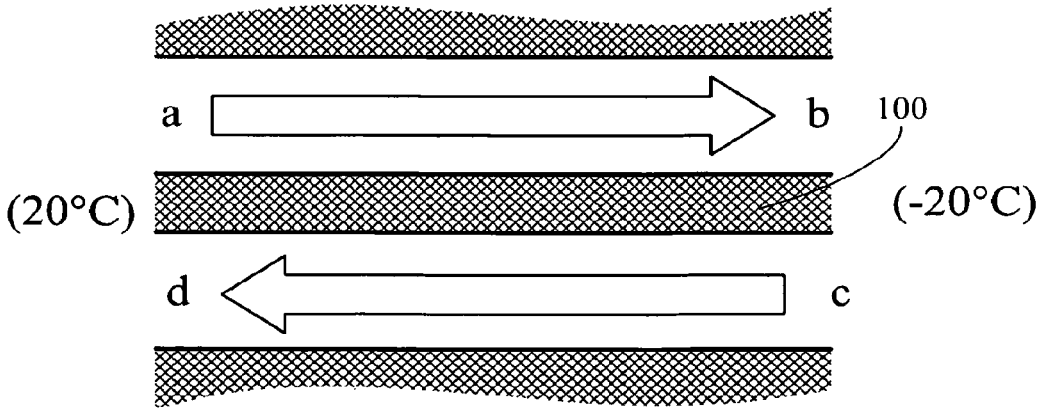
FIG. 8 (Prior Art)
FIG. 8 is the schematic view showing operating principles of the conventional heat exchange device having pumping fluids in different flowing directions during simultaneous operation.

FIG. 8 is the schematic view showing operating principles of the conventional heat exchange device having pumping fluids in different flowing directions during simultaneous operation.

Figure 9:
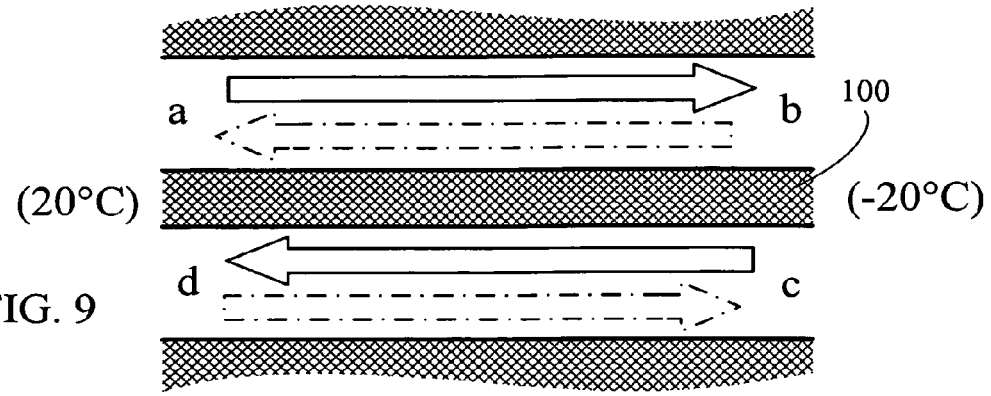
FIG. 9 is the schematic view showing the operation principles of the present invention.

FIG. 9 is the schematic view showing the operation principles of the present invention.

Figure 10:
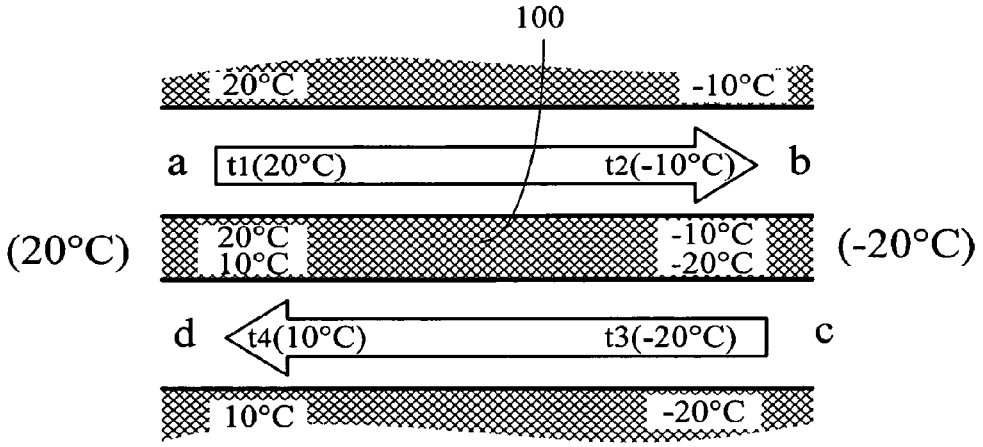
FIG. 10 (Prior Art)
FIG. 10 is the temperature distribution diagram of the heat exchange layer of the conventional heat exchange device having pumping fluids in different flowing directions during simultaneous operation.

FIG. 10 is the temperature distribution diagram of the heat exchange layer of the conventional heat exchange device having pumping fluids in different flowing directions during simultaneous operation.

Figure 11:
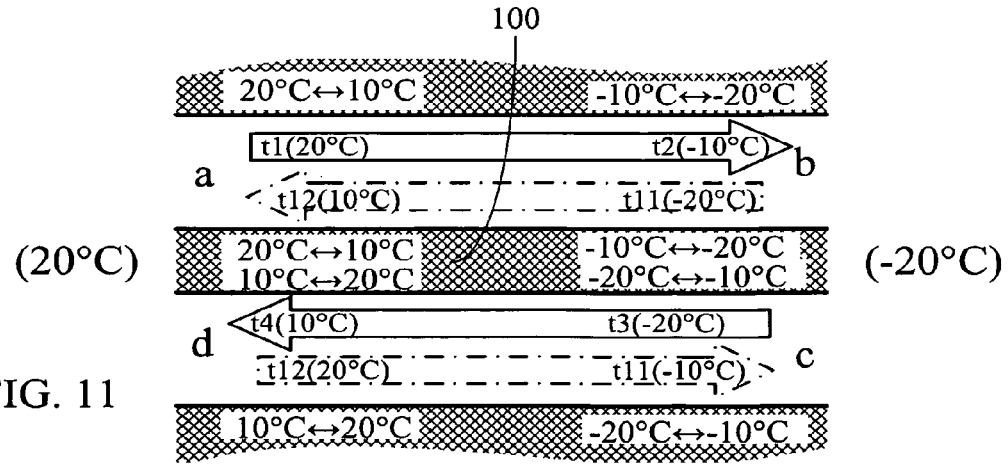
FIG. 11 is the temperature distribution variation diagram of the heat exchange layer of the present invention during simultaneous operation.

FIG. 11 is the temperature distribution variation diagram of the heat exchange layer of the present invention during simultaneous operation.

Figure 12:
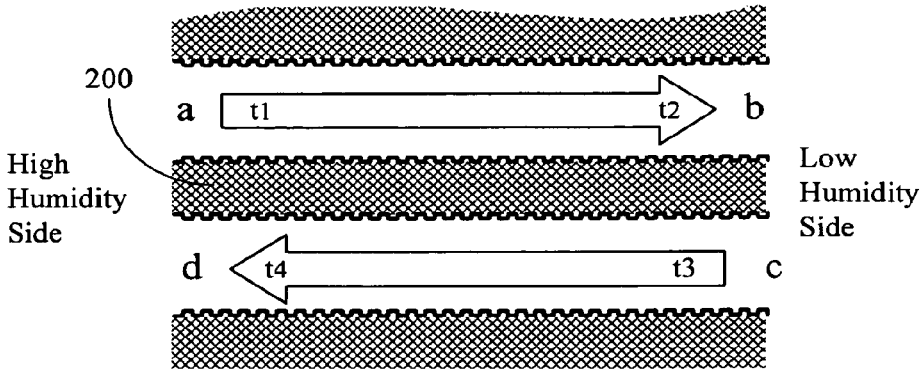
FIG. 12 (Prior Art)
FIG. 12 is the humidity distribution diagram of the total heat exchanger layer of the conventional heat exchange device having pumping fluids in different flowing directions during simultaneous operation being operated as the total heat exchange device having dehumidification function.
Figure 13:
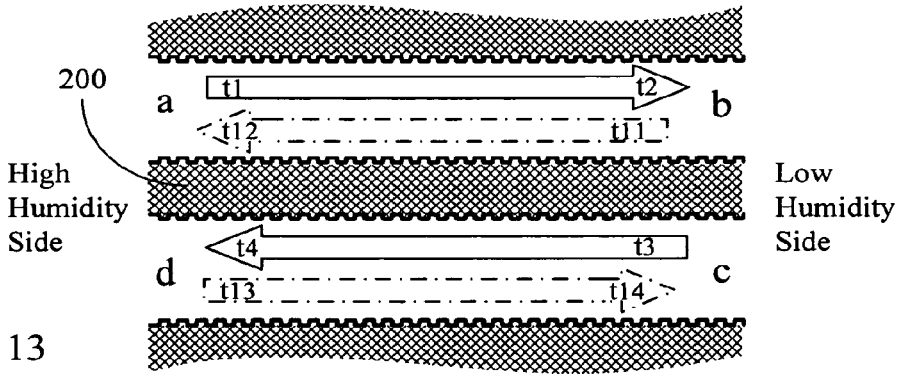
FIG. 13 is the humidity distribution diagram of the operating total heat exchange layer of the total heat exchange device having dehumidification function of the present invention.

FIG. 12 and FIG. 13 illustrate the comparison of conventional heat exchange device and the heat exchanger of the double flow-circuit heat exchange device for periodic positive and reverse directional pumping of the present invention applied in total heat exchange device.

FIG. 12 is the humidity distribution diagram of the total heat exchanger layer of the conventional heat exchange device having pumping fluids in different flowing directions during simultaneous operation being operated as the total heat exchange device having dehumidification function.

FIG. 13 is the humidity distribution diagram of the operating total heat exchange layer of the total heat exchange device having dehumidification function of the present invention.

From the difference of the temperature difference distribution and humidity distribution in aforementioned FIG. 10, FIG. 11, FIG. 12, FIG. 13 shows the advantage of present invention on promoting the heat exchanging effectiveness as well as the total heat exchanging performance.

The double flow-circuit heat exchange device for periodic positive and reverse directional pumping of the present invention further can be installed with at least one or more than one detecting device such as a temperature detecting device (11), humidity detecting device (21), and gaseous or liquid fluid composition detecting device (31) on the heat exchange device (1000), heat exchanger (100) or total heat exchanger (200) at positions near both or one of the first fluid port (a) and second fluid port (b), or at positions near both or one of the third fluid port (c) and fourth fluid port (d), or at other positions capable of detecting exchanging fluids. The aforementioned detecting devices can provide the detected signal as the reference for the operation of one or more than one functions as follows, including: 1) as the reference for operatively controlling the periodic switch timing of fluid flowing direction pumped by the bi-directional fluid pumping devices (123); or 2) as the reference for operatively controlling the bi-directional fluid pumping devices (123) to control the speed or the flow rate of the pumping fluid; or 3) as the reference for operatively controlling the open volume of the fluid valve to control the speed or the flow rate of the pumping fluid.

For the aforementioned temperature detecting device (11), humidity detecting device (21), and the gaseous or liquid fluid composition detecting device (31), all detecting devices can be in an integral structure, or some detecting devices have an integral structure, or each detecting device is in separated structure.

Figure 14:
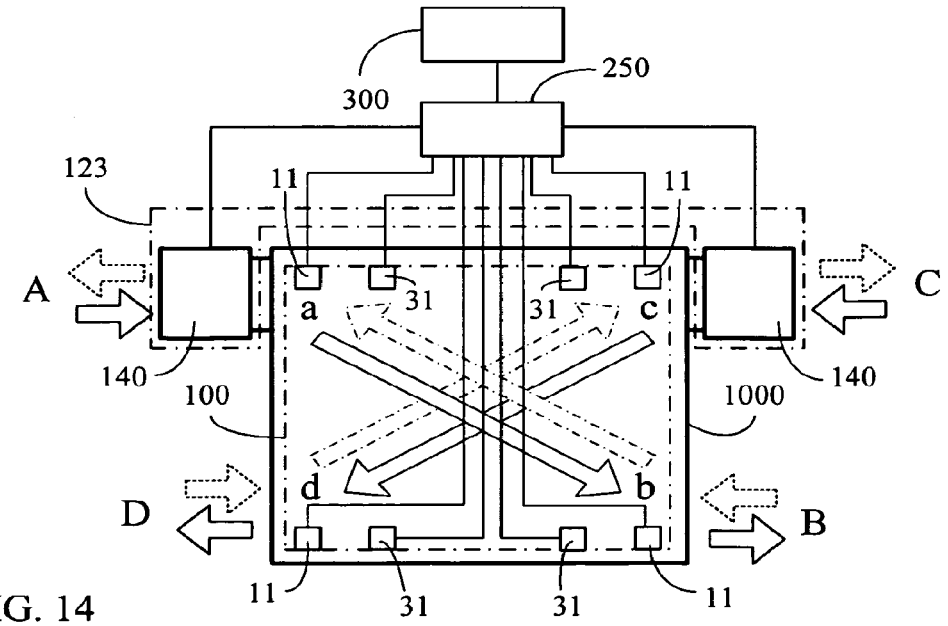
FIG. 14 is the structural principal schematic view of FIG. 2 being additionally installed with the gaseous or liquid fluid composition detecting device.

As shown in FIG. 14, the structural principal schematic view of FIG. 2 is additionally installed with a gaseous or liquid fluid composition detecting device.

For the double flow-circuit heat exchange device for periodic positive and reverse directional pumping, the conventional bi-directional heat exchange device (1000) is further installed with the bi-directional fluid pumping device (123) capable of positive and reverse directional pumping having two bi-directional fluid pumps (140), and installed with the periodic fluid direction-change operative control device (250) for operatively controlling the bi-directional fluid pumping device (123). The fluid direction-change operative control device (250) can change the flowing directions of the pumping fluid by periodic change of the controls of the two bi-directional fluid pumps of the bi-directional fluid pumping device (123) which are driven by power source (300), and can also constantly maintain the fluids in two different flowing directions to pass through the heat exchanger (100) inside the heat exchange device (1000).

The two bi-directional fluid pumps which are capable of producing positive pressure to push fluids or negative pressure to attract fluids are installed as the bi-directional fluid pumping device (123) for the application of pumping gaseous or liquid state fluids, and four fluid ports are installed at the heat exchange device (1000) to drive the bi-directional fluid pump (140) at the two sides of the heat exchanger (100) inside the heat exchange device (1000) by the electric power from power source (300) through the control of the periodic fluid directional-change operative control device (250). Furthermore, the flowing direction of said two fluid circuits are respectively fed or discharged from the fluid ports at different sides, and discharged or fed via the fluid port at the other side. The fluid is also pumped into the heat exchanger (100) of the heat exchange device (1000) through the first fluid port (a), passes through the fluid circuit at one side of the heat exchanger (100) and is discharged to outdoors via the second fluid port (b) as well as the fluid is pumped into the heat exchanger (100) of the heat exchange device (1000) through the third fluid port (c), passes through the fluid circuit at the other side of the heat exchanger (100) and is discharged to outdoors via the fourth fluid port (d). The first fluid port (a) and the second fluid port (b) are disposed for connecting to the same space or object while the third fluid port (c) and the fourth fluid port (d) are disposed for connecting to the other space or objects with temperature difference, thereby to periodically change the flowing directions of the two fluid circuits.

The heat exchanger (100) has two internal flow channels with heat absorbing/releasing capability, wherein the two flow channels are individually set with two fluid ports for separately pumping the fluid and is constituted by conventional heat exchange structure for the function of heat exchanging between two fluids.

Both or either one of the at least one temperature detecting device (11) and the at least one gaseous or liquid fluid composition detecting device (31) are installed at positions capable of directly or indirectly detecting the temperature variation, or gaseous and liquid fluid composition variation of pumping fluid, wherein the detected signals are used as the reference to determine the periodic switching timing of fluid flowing direction change operation.

The aforementioned temperature detecting device (11) and the gaseous or liquid fluid composition detecting device (31) can be constructed as an integral structure or as separated structures.

The bi-directional fluid pumping device (123) may comprise:

1) Two bi-directional pumps (140) capable of producing positive pressure to push fluid or negative pressure to attract fluid are pumped in opposite directions to constitute the bi-directional fluid pumping device (123) for pumping gaseous or liquid state fluids, wherein the two fluid pumps in opposite directions can be respectively equipped with an electric motor or share a common electric motor, thereby being subject to the operative control of the periodic fluid direction-change operative control device (250) to rotate positively or reversely to change the flowing direction of the pumping fluid; and 2) Fluid pumps capable of simultaneously pumping in opposite directions individually as well as periodically changing the pumping directions.

The above pumping methods include 1) producing negative pressure to push the fluid; or 2) producing positive pressure to attract the fluid.

Said bi-directional fluid pumping device (123) and said heat exchange device (1000) can be constructed as an integral structure or as separated structures.

Power source (300) provides the operating power source, including AC or DC city power or acts as standalone electric power supplying devices.

The periodic fluid direction-change operative control device (250) comprises electromechanical components, solid state electronic components, or microprocessors with related software and control interfaces to operatively control the two bi-directional fluid pumps (140) inside the bi-directional fluid pumping device (123) for periodically changing the flowing direction of the two fluids in different flowing directions passing through the heat exchange device (1000), thereby operatively controlling the temperature distribution status between the fluids and the heat exchanger (100) of the heat exchange device (1000).

The timing of periodic fluid direction-change can be controlled as: 1) an open-loop operation with pre-set periodic fluid direction changing timing; or 2) randomly manual switching; or 3) installing both or either one of the at least one temperature detecting device (11) and the at least one gaseous or liquid fluid composition detecting device (31) at positions capable of directly or indirectly detecting the temperature variation, or gaseous and liquid fluid composition variation of pumping fluid, wherein the detected signals are used as the reference to determine the periodic switching timing of fluid flowing direction change operation.

Figure 15:
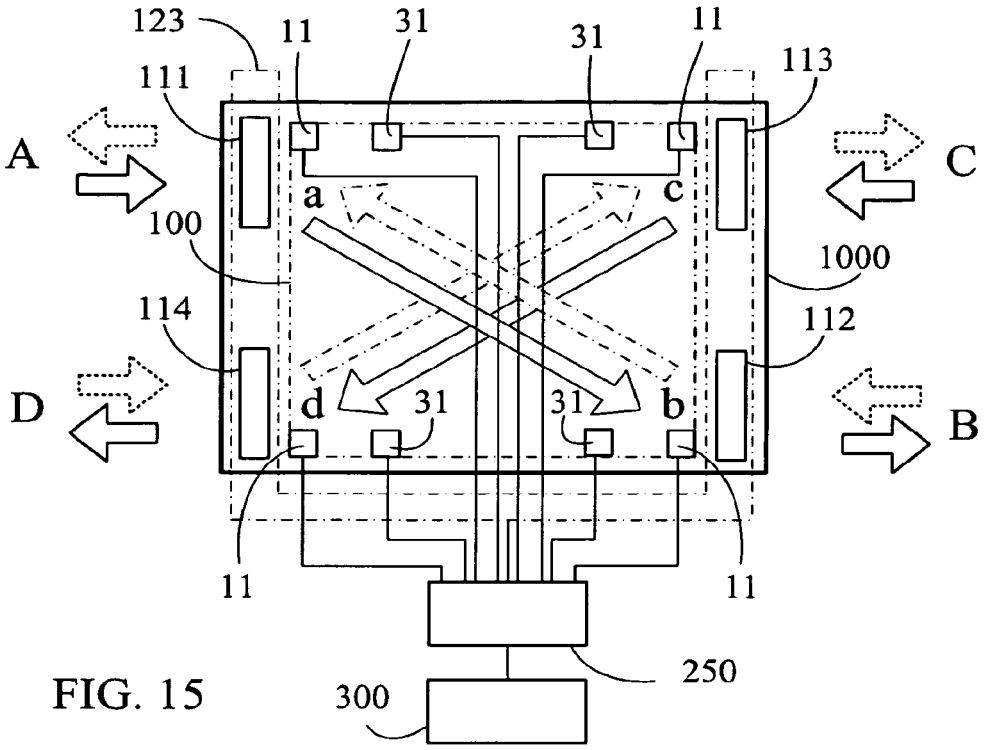
FIG. 15 is the structural principal schematic view of FIG. 3 being additionally installed with the gaseous or liquid fluid composition detecting device.

As shown in FIG. 15, the structural principal schematic view of FIG. 3 is additionally installed with the gaseous or liquid fluid composition detecting device.

In this embodiment, the first fluid port (a), second fluid port (b), third fluid port (c), and fourth fluid port (d) of bi-directional fluid in the heat exchange device (1000) are respectively installed with bi-directional fluid pumps (111), (112), (113), (114) capable of producing negative pressure or positive pressure to constitute the bi-directional fluid pumping device (123). The bi-directional fluid pumps (111), (112), (113), (114) are capable of producing negative pressure or positive pressure in the bi-directional fluid pumping device (123) driven by electric power source (300) to periodically change the flowing direction of the pumping fluid and constantly maintain the two fluid circuits in different directions through the heat exchanger (100).

Additionally, the heat exchange device (1000) and the bi-directional fluid pumps (111), (112), (113), (114) which are capable of producing negative pressure or positive pressure can be integrated in one device or separately installed to constitute the function of bi-directional fluid pumping device (123). The four bi-directional fluid pumps (111), (112), (113), (114) are separately installed at first fluid port (a), second fluid port (b), third fluid port (c) and fourth fluid port (d) for generating the pumping to change the fluids to different flowing directions. Additionally, the aforementioned bi-directional fluid pumps (111), (112), (113), (114) are controlled by the periodic fluid direction-change operative control device (250). The fluid pumps (111) and (113) can be installed at first fluid port (a) and third fluid port (c) to form one set of pumps, which could be driven by individually installed electric motors, or jointly driven by single electric motor, while the fluid pumps (112) and (114) form another set, which could be driven by individually installed electric motors, or jointly driven by single electric motor. Under the control of periodic fluid direction-change operative control device (250) one or multiple of the following operating functions can be provided: 1) partial control of the bi-directional fluid pumps so that the pumps alternately pump in negative pressure to allow the two fluid circuits in different flowing directions periodically changing flowing directions; or 2) partial control of the bi-directional fluid pumps to alternately pump in positive pressure periodically to allow the two fluid circuits flowing in different flowing directions to periodically change flowing directions; 3) partial or all of the bi-directional fluid pumps forming auxiliary pumping by the positive pressure pumping and negative pressure pumping generated by different fluid pumps in the same fluid circuits, thereby allowing two fluid circuits in different flowing directions to periodically change flowing direction. In the aforementioned functions, the flowing direction of the fluid inside the two channels at both sides of the heat exchanger (100) in the heat exchange device (1000) maintains opposite flowing directions.

Both or either one of the at least one temperature detecting device (11) and the at least one gaseous or liquid fluid composition detecting device (31) are installed at positions capable of directly or indirectly detecting the temperature variation, or gaseous or liquid fluid composition variation of pumping fluid. The detected signals are used as the reference to determine the periodic switch timing for the fluid flowing direction change operation.

The aforementioned temperature detecting device (11) and gaseous or liquid fluid composition detecting device (31) can be installed as an integral structure or as separated structures.

Bi-directional fluid pumping device (123) comprises first fluid port (a), second fluid port (b), third fluid port (c), and fourth fluid port (d) and are individually installed with bi-directional fluid pumps (111), (112), (113), (114) capable of producing positive pressures or negative pressure, thereby to constitute the bi-directional fluid pumping device (123). The periodic fluid direction-change operative control device (250) operatively controls the bi-directional fluid pumping device (123) which is driven by electric power source (300) for periodic fluid direction changing operation, and constantly maintains the two fluid circuits flowing in different direction.

The power source (300) provides the operating power source, including AC or DC city power or acts as standalone electric power supplying devices.

The periodic fluid direction-change operative control device (250) comprises electromechanical components, solid state electronic components, or microprocessors with related software and control interfaces to operatively control individual bi-directional fluid pumps (111), (112), (113), (114) that constitute the bi-directional fluid pumping device (123), for the periodic fluid direction changing operation of the two different direction fluid through the heat exchange device to control the temperature distribution status between the fluid and the heat exchanger (100) of the heat exchange device.

The heat exchanger (100) has two internal flow channels with heat absorbing/releasing capability, wherein the two flow channels are individually set with two fluid ports at both sides for separately fluid pumping and is constituted by conventional heat exchange structure for the function of heat exchanging between two fluids.

The timing of periodic fluid direction-change can be controlled as: 1) an open-loop operation with pre-set periodic fluid direction changing timing; or 2) randomly manual switching; or 3) installing both or either one of the at least one temperature detecting device (11) and the at least one gaseous or liquid fluid composition detecting device (31) at positions capable of directly or indirectly detecting the temperature variation, or gaseous or liquid fluid composition variation of pumping fluid, wherein the detected signals are used as the reference to determine the periodic switch timing of fluid flowing direction change operation.

Figure 16:
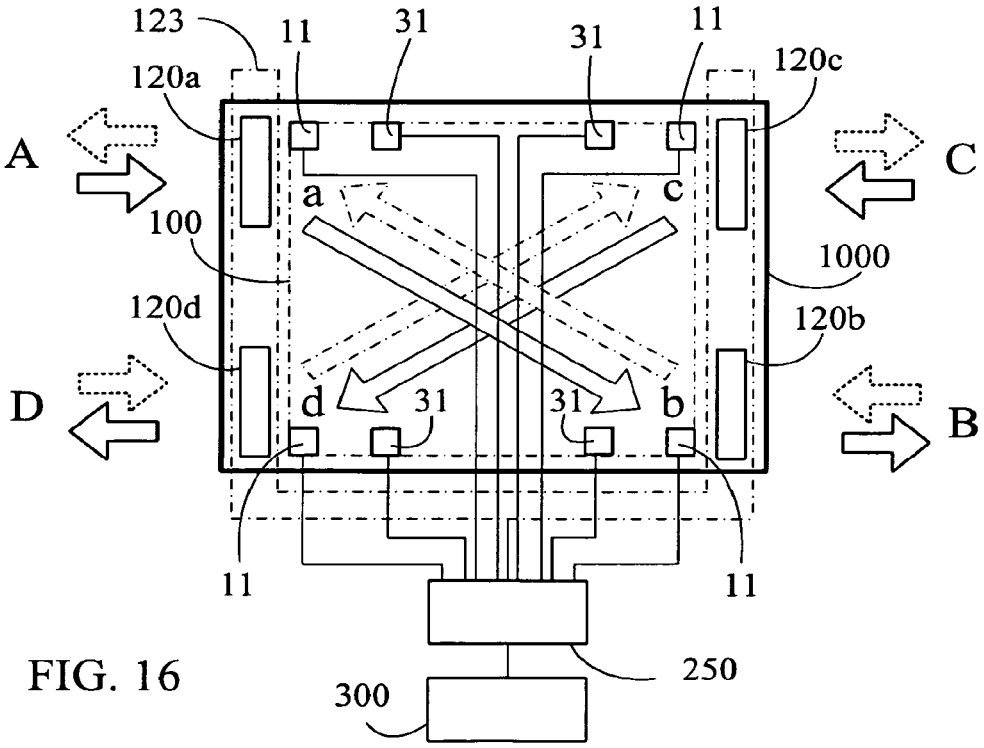
FIG. 16 is the structural principal schematic view of FIG. 4 being additionally installed with the gaseous or liquid fluid composition detecting device.

As shown in FIG. 16, the structural principal schematic view of FIG. 4 is additionally installed with the gaseous or liquid fluid composition detecting device.

In this embodiment, the first fluid port (a), second fluid port (b), third fluid port (c), and fourth fluid port (d) of the two flow channels of the two bi-directional fluid of heat exchanging device (1000) of the present invention can be separately installed with the unidirectional fluid pump (120*a*), (120*b*), (120*c*), (120*d*) for unidirectional pumping to constitute the bi-directional fluid pumping device (123). Electrical power from the electrical power source (300) is provided by the periodic fluid direction-change operative control device (250) to control the unidirectional pumps (120*a*), (120*b*), (120*c*), (120*d*) of the bi-directional fluid pumping device (123) to periodically change the flowing direction of the pumping fluid, and to constantly maintain the fluid flowing directions in different directions.

The heat exchanging device (1000) and unidirectional fluid pumps (120*a*), (120*b*), (120*c*), (120*d*) can be integrated as one device or separately installed to constitute the function of the bi-directional fluid pumping device (123), wherein the four unidirectional fluid pumps (120*a*), (120*b*), (120*c*), (120*d*) are separately installed at first fluid port (a), second fluid port (b), third fluid port (c) and fourth fluid port (d) for fluid pumping. The unidirectional fluid pumps (120*a*), (120*b*), (120*c*), (120*d*) can also be controlled by the periodic fluid direction-change operative control device (250). The unidirectional fluid pumps (120*a*) and (120*c*) installed at the first fluid port (a) and third fluid port (c) can form one set of pumps, which could be driven by individually installed electric motors, or jointly driven by single electric motor, while the unidirectional fluid pumps (120*b*) and (120*c*) form another set of pumps, which could be driven by individually installed electric motors, or jointly driven by single electric motor. Under the control of periodic fluid direction-change operative control device (250), one or multiple of the following functions and structures can be provided, including: 1) The arrangement of unidirectional pumps for negative pressure pumping on fluids, wherein the unidirectional fluid pump (120*a*) and unidirectional fluid pump (120*c*) form one set, and the unidirectional fluid pump (120*b*) and unidirectional fluid pump (120*d*) form the other set, and that the two sets provide periodic negative pressure pumping alternately to make the fluids with different flowing direction in two channels to change their flowing direction periodically; or 2) The arrangement of unidirectional pumps for positive pressure pumping on fluids, wherein the unidirectional fluid pump (120*a*) and unidirectional fluid pump (120*c*) form one set, and the unidirectional fluid pump (120*b*) and unidirectional fluid pump (120*d*) form the other set, and that the two sets provide periodic positive pressure pumping alternately to make the fluids with different flowing direction in two channels changing their flowing direction periodically.

In the aforementioned two functions, the flowing direction of the fluid inside the two channels at both sides of the heat exchanger (100) in the heat exchange device (1000) maintains opposite flowing directions.

Both or either one of the at least one temperature detecting device (11) and the at least one gaseous or liquid fluid composition detecting device (31) can be installed at positions capable of directly or indirectly detecting the temperature variation, or gaseous or liquid fluid composition variation of pumping fluid, wherein the detected signals are used as the reference to determine the periodic switch timing for the fluid flowing direction change operation.

The aforementioned temperature detecting device (11) and gaseous or liquid fluid composition detecting device (31) can be constructed as an integral structure or as separated structures.

Bi-directional fluid pumping device (123) comprises first fluid port (a), second fluid port (b), third fluid port (c), and fourth fluid port (d) and are individually installed with unidirectional fluid pumps (120*a*), (120*b*), (120*c*), (120*d*) capable of unidirectional pumping to constitute the bi-directional fluid pumping device (123)). The periodic fluid direction-change operative control device (250) operatively controls the bi-directional fluid pumping device (123) which is driven by electric power source (300) for periodic fluid direction changing operation, and constantly maintains the two fluid circuits flowing in different directions.

The power source (300) provides the operating power source, including AC or DC city power or acts as standalone electric power supplying devices.

The periodic fluid direction-change operative control device (250) comprises by electromechanical components, solid state electronic components, or microprocessors with related software and control interfaces to operatively control individual unidirectional fluid pumps (120*a*), (120*b*), (120*c*), (120*d*) that constitute the bi-directional fluid pumping device (123), for the periodic fluid direction changing operation of the two different direction fluid through the two channels of the heat exchanger (100), thereby operatively controlling the temperature distribution status between the fluid and the heat exchanger (100) of the heat exchange device (1000).

The heat exchanger (100) has two internal flow channels with heat absorbing/releasing capability, wherein the two flow channels are individually set with two fluid ports at both sides for separately pumping fluid and has a conventional heat exchange structure for the function of heat exchanging between two fluids.

The timing of periodic fluid direction-change can be controlled as: 1) an open-loop operation with pre-set periodic fluid direction changing timing; or 2) randomly manual switching; or 3) installing both or either one of the at least one temperature detecting device (11) and the at least one gaseous or liquid fluid composition detecting device (31) at positions capable of directly or indirectly detecting the temperature variation, or gaseous or liquid fluid composition variation of pumping fluid, wherein the detected signals are used as the reference to determine the periodic switch timing of fluid flowing direction change operation.

Figure 17:
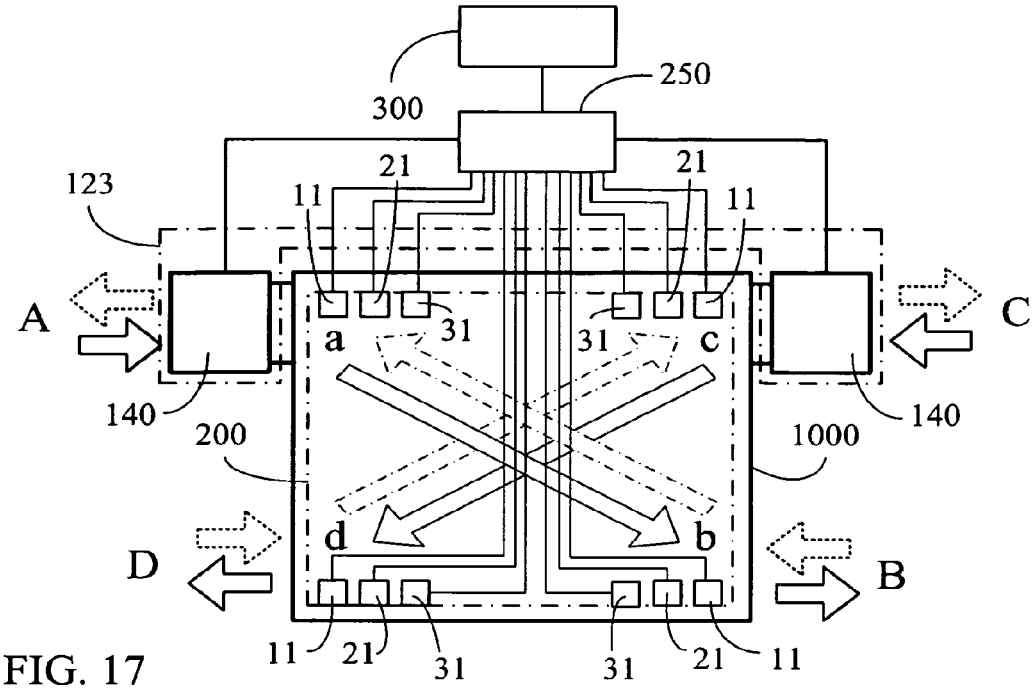
FIG. 17 is the structural principal schematic view of FIG. 5 being additionally installed with the gaseous or liquid fluid composition detecting device.

As shown in FIG. 17, the structural principal schematic view of FIG. 5 is additionally installed with the gaseous or liquid fluid composition detecting device.

In this embodiment, the conventional bi-directional heat exchange device (1000) is further installed with the bi-directional fluid pumping device (123) capable of positive and reverse directional pumping which has two bi-directional fluid pumps (140), and is further installed with the periodic fluid direction-change operative control device (250) for operatively controlling the bi-directional fluid pumping device (123). The bi-directional fluid pumping device (250) allows the two different flowing direction fluids to periodically change the flowing directions that is operated with the two bi-directional fluid pumps (140) of the bi-directional fluid pumping device (123) driven by power source (300), and constantly maintains the two fluid circuits in two different flowing directions inside the heat exchange device (1000).

At least one of the at least one temperature detecting device (11), the at least one humidity detecting device (21) and the at least one gaseous or liquid fluid composition detecting device (31) can be installed at positions capable of directly or indirectly detecting the temperature variation, humidity variation, or gaseous or liquid fluid composition variation of pumping fluid, wherein the detected signals are used as the reference to determine the periodic switch timing of fluid flowing direction change operation.

In this instance, the temperature detecting device (11), humidity detecting device (21), and the gaseous or liquid fluid composition detecting device (31), or other detecting devices can be all constructed as an integral structure, or some of the detecting devices can be an integral structure, or each detecting device can be separated structures.

The bi-directional fluid pumping device (123) can have:

1) Two bi-directional pumps (140) capable of producing positive pressure to push fluid or negative pressure to attract fluid are used to pump the fluids in opposite directions to constitute the bi-directional fluid pumping device (123) for pumping gaseous or liquid state fluids, wherein the two fluid pumps in opposite directions can be separately equipped with an electric motor or share a common electric motor, thereby being subject to the operative control of the periodic fluid direction-change operative control device (250) to positively or reversely change the flowing direction of the pumping fluid; and
2) The fluid pumps are capable of simultaneously pumping in opposite directions individually as well as periodically changing the pumping directions.

The above pumping methods include 1) producing negative pressure to push the fluid; or 2) producing positive pressure to attract the fluid.

Said bi-directional fluid pumping device (123) and said heat exchange device (1000) can be constructed as an integral structure or as separate structures.

Power source (300) provides the operating power source, including AC or DC city power or acts as standalone electric power supplying devices.

The periodic fluid direction-change operative control device (250) comprises electromechanical components, solid state electronic components, or microprocessors with related software and control interfaces to operatively control the two bi-directional fluid pumps (140) inside the bi-directional fluid pumping device (123) for periodically changing the flowing direction of the two fluids in different flowing directions passing through the heat exchange device (1000), thereby operatively controlling 1) the temperature distribution status; or 2) the humidity distribution status; or 3) both of the temperature and humidity distribution between the fluid and the total heat exchanger (200) of the heat exchange device (1000).

Total heat exchanger (200) has two internal flow channels with heat absorbing/releasing and humidity absorbing/releasing capability, wherein the two flow channels are individually set with two fluid ports at both sides for separately pumping fluid and has a conventional total heat exchange structure for the function of heat exchanging between two fluids and function of de-humid capability.

The timing of periodic direction change of flowing fluid can be controlled as: 1) as open-loop operation with pre-set periodic fluid direction changing timing; or 2) randomly manual switching; or 3) installing all or at least one of the at least one temperature detecting device (11), the at least one humidity detecting device (21) and the at least one gaseous or liquid fluid composition detecting device (31) at positions capable of directly or indirectly detecting the temperature variation, humidity variation, or gaseous or liquid fluid composition variation of pumping fluid, wherein the detected signals are used as the reference to determine the periodic switch timing of fluid flowing direction change operation.

Figure 18:
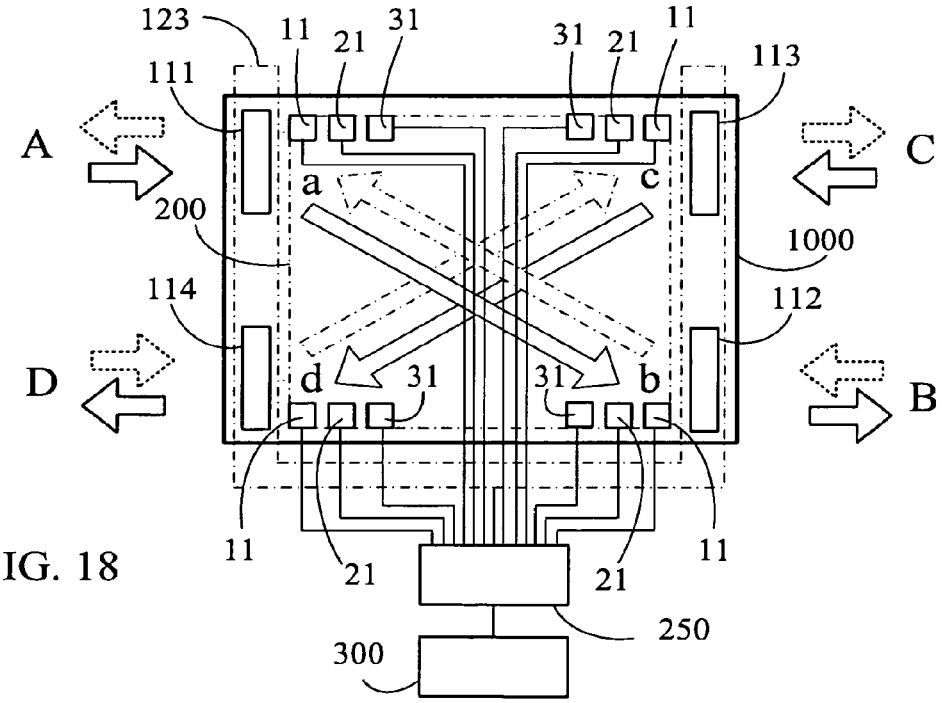
FIG. 18 is the structural principal schematic view of FIG. 6 being additionally installed with the gaseous or liquid fluid composition detecting device.

As shown in FIG. 18, the structural principal schematic view of FIG. 6 is additionally installed with the gaseous or liquid fluid composition detecting device.

As shown in FIG. 18, the first fluid port (a), second fluid port (b), third fluid port (c), and fourth fluid port (d) in the heat exchange device (1000) are respectively installed with bi-directional fluid pumps (111), (112), (113), (114) capable of producing negative pressure or positive pressure to constitute the bi-directional fluid pumping device (123). The bi-directional fluid pumps (111), (112), (113), (114) are capable of producing negative pressure or positive pressure in the bi-directional fluid pumping device (123) which are driven by electric power source (300) by the periodic fluid direction-change operative control device (250) to periodically change the flowing direction of the pumping fluid and constantly maintain the two fluid circuits flowing in different directions.

The heat exchange device (1000) and the bi-directional fluid pumps (111), (112), (113), (114) can be integrated as one device or separately installed to constitute the function of bi-directional fluid pumping device (123), wherein the four bi-directional fluid pumps (111), (112), (113), (114) capable of producing negative pressure or positive pressure are separately installed at first fluid port (a), second fluid port (b), third fluid port (c) and fourth fluid port (d) for generating the pumping to change the fluids flowing in different directions. The aforementioned bi-directional fluid pumps (111), (112), (113), (114) are controlled by the periodic fluid direction-change operative control device (250), where the fluid pumps (111) and (113) installed at first fluid port (a) and third fluid port (c) to form one set of pumps, which could be driven by individually installed electric motors, or jointly driven by single electric motor, while the fluid pumps (112) and (114) form another set of pumps, which could be driven by individually installed electric motors, or jointly driven by single electric motor, under the control of periodic fluid direction-change operative control device (250) to provide one or more of the following operating functions, including: 1) partial control of the bi-directional fluid pumps to alternately pump periodically in negative pressure to allow the two fluid circuits in different flowing directions to change the respective flowing directions; or 2) partial control of the bi-directional fluid pumps to alternately pump in positive pressure to periodically allow the two fluid circuits flowing in different flowing directions to change flowing directions; 3) partial or all of the bi-directional fluid pumps form auxiliary pumping by the positive pressure pumping and negative pressure pumping generated by different fluid pumps in the same fluid circuits, thereby allowing two fluid circuits in different flowing directions to periodically change flowing directions. In the aforementioned functions, the flowing direction of the fluid inside the two channels at both sides of the total heat exchanger (200) in the heat exchange device (1000) maintains opposite flowing directions.

At least one of the at least one temperature detecting device (11), the at least one humidity detecting device (21) and the at least one gaseous or liquid fluid composition detecting device (31) can be installed at positions capable of directly or indirectly detecting the temperature variation, humidity variation, or gaseous or liquid fluid composition variation of pumping fluid, wherein the detected signals are used as the reference to determine the periodic switch timing of fluid flowing direction change operation.

For the aforementioned temperature detecting device (11), humidity detecting device (21), and the gaseous or liquid fluid composition detecting device (31), all detecting devices can be constructed as an integral structure, or some detecting devices as an integral structure, or each detecting device are separate structures.

Bi-directional fluid pumping device (123) comprises first fluid port (a), second fluid port (b), third fluid port (c), and fourth fluid port (d) and are individually installed with bi-directional fluid pumps (111), (112), (113), (114) capable of producing positive pressures or negative pressure, thereby to constitute the bi-directional fluid pumping device (123). The periodic fluid direction-change operative control device (250) operatively controls the bi-directional fluid pumping device (123) which is driven by electric power source (300) for periodic fluid direction changing operation, and constantly maintains the two fluid circuits flowing in different direction.

The power source (300) provides the operating power source, including AC or DC city power or acts as standalone electric power supplying devices.

The periodic fluid direction-change operative control device (250) comprises electromechanical components, solid state electronic components, or microprocessors with related software and control interfaces to operatively control the bi-directional fluid pumps (111), (112), (113), (114) capable of producing negative pressure or positive pressure to constitute the bi-directional fluid pumping device (123), for the periodic fluid direction changing operation of the two different direction fluid through the two channels of the heat exchanging device to control 1) the temperature distribution status; or 2) the humidity distribution status; or 3) both of the temperature and humidity distribution between the fluid and the total heat exchanger (200) of the heat exchange device.

Total heat exchanger (200) has two internal flow channels with heat absorbing/releasing and humidity absorbing/releasing capability, wherein the two flow channels are individually set with two fluid ports at both sides for separately pumping fluid and has a conventional total heat exchange structure for the function of heat exchanging between two fluids and function of de-humid capability.

The timing of periodic direction change of flowing fluid can be controlled as: 1) an open-loop operation with pre-set periodic fluid direction changing timing; or 2) randomly manual switching; or 3) installing all or at least one of the at least one temperature detecting device (11), the at least one humidity detecting device (21) and the at least one gaseous or liquid fluid composition detecting device (31) at positions capable of directly or indirectly detecting the temperature variation, humidity variation, or gaseous or liquid fluid composition variation of pumping fluid, wherein the detected signals are used as the reference to determine the periodic switch timing of fluid flowing direction change operation.

Figure 19:
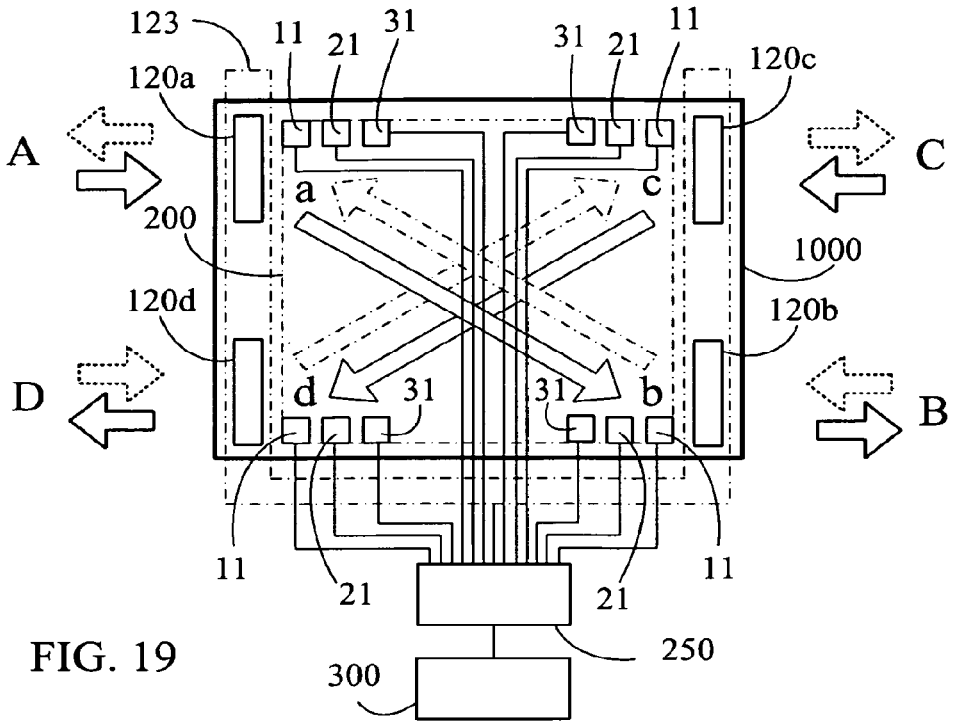
FIG. 19 is the structural principal schematic view of FIG. 7 being additionally installed with the gaseous or liquid fluid composition detecting device.

As shown in FIG. 19, the structural principal schematic view of FIG. 7 is additionally installed with the gaseous or liquid fluid composition detecting device.

As shown in FIG. 19, the first fluid port (a), second fluid port (b), third fluid port (c), and fourth fluid port (d) of the two flow channels of the two bi-directional fluids of heat exchanging device (1000) are separately install with the unidirectional fluid pump (120*a*), (120*b*), (120*c*), (120*d*) for unidirectional pumping to constitute the bi-directional fluid pumping device (123). The electrical power from the electrical power source (300) is controlled by the periodic fluid direction-change operative control device (250) to control the unidirectional pumps (120*a*), (120*b*), (120*c*), (120*d*) of the bi-directional fluid pumping device (123) to periodically change the flowing direction of the pumping fluid, and to constantly maintain the fluid flowing directions of both circuits in different direction.

In this embodiment, the heat exchanging device (1000) and unidirectional fluid pumps (120*a*), (120*b*), (120*c*), (120*d*) can be integrated as one device or separately installed to constitute the function of bi-directional fluid pumping device (123), wherein the four unidirectional fluid pumps (120*a*), (120*b*), (120*c*), (120*d*) are separately installed at fluid port first fluid port (a), second fluid port (b), third fluid port (c) and fourth fluid port (d) for fluid pumping. The aforementioned unidirectional fluid pumps (120*a*), (120*b*), (120*c*), (120*d*) are controlled by the periodic fluid direction-change operative control device (250). The unidirectional fluid pumps (120*a*) and (120*c*) installed at the first fluid port (a) and the third fluid port (c) to form one set of pumps, which could be driven by individually installed electric motors, or jointly driven by single electric motor, while the unidirectional fluid pumps (120*b*) and (120*c*) form another set of pumps, which could be driven by individually installed electric motors, or jointly driven by single electric motor. Under the control of periodic fluid direction-change operative control device (250) one or multiple of the following functions and structures can be provided to change the flowing direction, including:

1) The arrangement of unidirectional pumps for negative pressure pumping on fluids, wherein the unidirectional fluid pump (120*a*) and unidirectional fluid pump (120*c*) form one set, and the unidirectional fluid pump (120*b*) and unidirectional fluid pump (120*d*) form the other set, and that the two sets provide periodic negative pressure pumping alternately to make the fluids with different flowing direction in two channels changing their flowing direction periodically; or
2) The arrangement of unidirectional pumps for positive pressure pumping on fluids, wherein the unidirectional fluid pump (120*a*) and unidirectional fluid pump (120*c*) form one set, and the unidirectional fluid pump (120*b*) and unidirectional fluid pump (120*d*) form the other set, and that the two sets alternately provide periodic positive pressure pumping to make the fluids with different flowing direction in two channels changing their flowing direction periodically.

In the aforementioned functions, the flowing direction of the fluid inside the two channels at both sides of total heat exchanger (200) in the heat exchange device (1000) maintains opposite flowing directions.

At least one of the at least one temperature detecting device (11), the at least one humidity detecting device (21) and the at least one gaseous or liquid fluid composition detecting device (31) can be installed at positions capable of directly or indirectly detecting the temperature variation, humidity variation, or gaseous or liquid fluid composition variation of pumping fluid, wherein the detected signals are used as the reference to determine the periodic switch timing of fluid flowing direction change operation.

For the aforementioned temperature detecting device (11), humidity detecting device (21), and the gaseous or liquid fluid composition detecting device (31), all detecting devices can be constructed as an integral structure, or some detecting devices as an integral structure, or each detecting device are separate structures.

Bi-directional fluid pumping device (123) comprises first fluid port (a), second fluid port (b), third fluid port (c), and fourth fluid port (d) and are individually installed with unidirectional fluid pumps (120*a*), (120*b*), (120*c*), (120*d*) capable of unidirectional pumping to constitute the bi-directional fluid pumping device (123). The periodic fluid direction-change operative control device (250) operatively controls the bi-directional fluid pumping device (123) which is driven by electric power source (300) for periodic fluid direction changing operation, and constantly maintains the two fluid circuits flowing in different directions.

The power source (300) provides the operating power source, including AC or DC city power or acts as standalone electric power supplying devices.

The periodic fluid direction-change operative control device (250) comprises electromechanical components, solid state electronic components, or microprocessors with related software and control interfaces to operatively control individual unidirectional fluid pumps (120*a*), (120*b*), (120*c*), (120*d*) that constitute the bi-directional fluid pumping device (123), for the periodic fluid direction changing operation of the two different direction fluid through the two channels of the heat exchange device to control 1) the temperature distribution status; or 2) the humidity distribution status; or 3) both of the temperature and humidity distribution between the fluid and the total heat exchanger (200) of the heat exchange device.

Total heat exchanger (200) has two internal flow channels with heat absorbing/releasing and humidity absorbing/releasing capability, wherein the two flow channels are individually set with two fluid ports at both sides for separately pumping fluid and has a conventional total heat exchange structure for the function of heat exchanging between two fluids and function of de-humid capability.

The timing of periodic direction change of flowing fluid can be controlled as: 1) an open-loop operation with pre-set periodic fluid direction changing timing; or 2) randomly manual switching; or 3) installing all or at least one of the at least one temperature detecting device (11), the at least one humidity detecting device (21) and the at least one gaseous or liquid fluid composition detecting device (31) at positions capable of directly or indirectly detecting the temperature variation, humidity variation, or gaseous or liquid fluid composition variation of pumping fluid, wherein the detected signals are used as the reference to determine the periodic switch timing of fluid flowing direction change operation.

Figure 20:
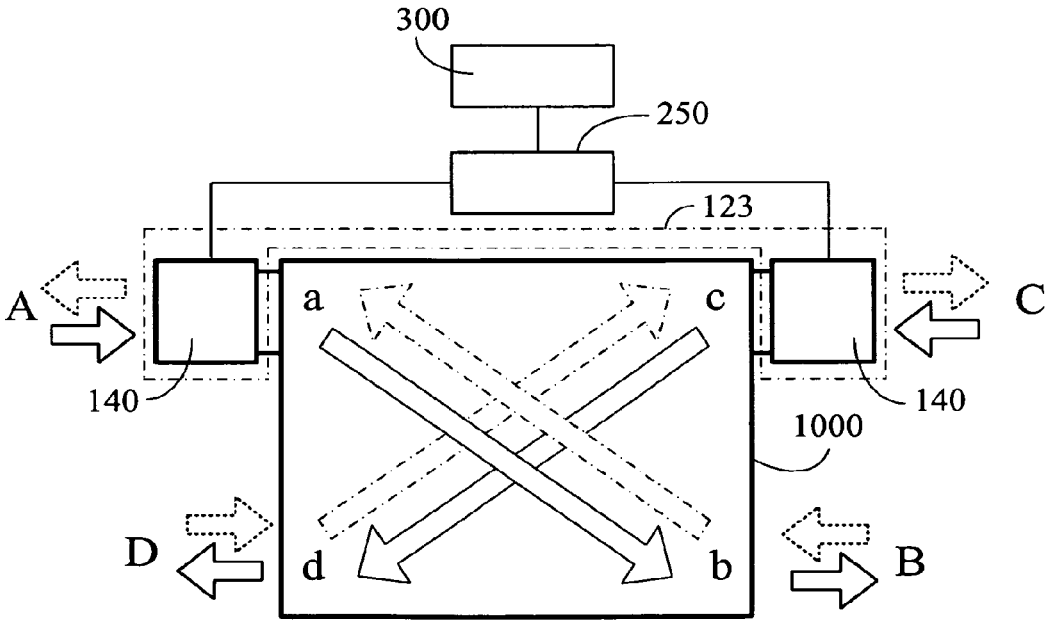
FIG. 20 is the embodied schematic view of the present invention showing that at least two fluid pumps capable of bi-directionally fluid pumping are installed between the fluid source and both ends of common inlet/outlet port of the first fluid circuit and the second fluid circuit.
Figure 21:
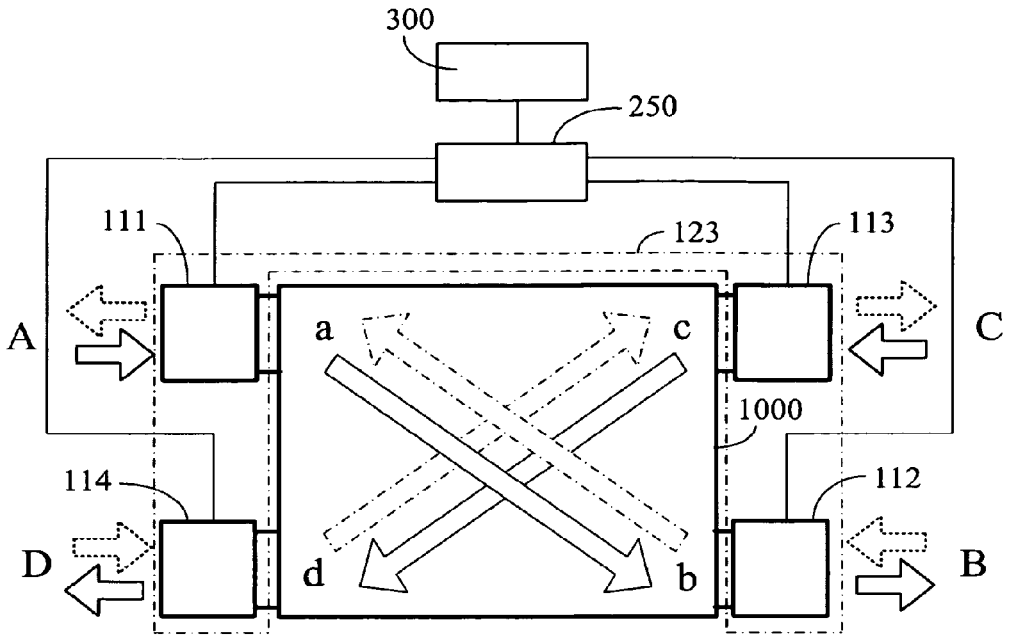
FIG. 21 is the embodied schematic view of present invention showing that at least four bi-directional fluid pumps are installed, wherein two of the bi-directional fluid pumps are installed at the fluid ports (a), (b) of two ends of the first fluid circuit of the heat exchange device, while the other two of the bi-directional fluid pumps are installed at the fluid ports (c), (d) of two ends of the second fluid circuit.

According to the above operating functions, the selectable embodiments of the bi-directional fluid pumping devices (123) of the double flow-circuit heat exchange device for periodic positive and reverse directional pumping of the present invention includes one or more of the following structures, including:

1. Having at least two fluid pumps (140) capable of bi-directionally fluid pumping installed on the common fluid port of two different fluid channels to operatively control the bi-directional fluid pump to periodically pump in positive or reverse directions, thereby periodically changing the fluid direction. As shown in FIG. 20, at least two fluid pumps capable of bi-directionally fluid pumping are installed between the fluid source and both ends of the common inlet/outlet port of the first fluid circuit and the second fluid circuit.
2. Having at least four bi-directional fluid pumps (111,112, 113,114) capable of producing negative pressure or positive pressure, wherein two bi-directional fluid pumps (111, 112) are installed at the fluid ports (a), (b) on the two ends of the first fluid circuit of the heat exchange device (1000), while the other two bi-directional fluid pumps (113,114) are installed at the fluid ports (c), (d) on the two ends of the second fluid circuit. The periodic fluid direction-change operative control device (250) controls the operation of the at least four bi-directional fluid pumps and provides one or multiple following functions, including: 1) when the bi-directional fluid pumps (111,113) are installed at one end of the first fluid circuit and the second fluid circuit to operate in negative pressure pumping, and bi-directional fluid pumps (112,114) are installed at the other end of the first fluid circuit and second fluid circuit the pumps are alternately operated in a negative pressure pumping operation to provide the periodic change in the flowing direction of the fluid; or 2) when the bi-directional fluid pumps (111, 113) are installed at one end of the first fluid circuit and the second fluid circuit to operate in positive pressure pumping, and bi-directional fluid pumps (112,114) are installed at the other end of the first fluid circuit and second fluid circuit the pumps are alternately operated in a positive pressure pumping operation to provide the periodic change in the flowing direction of the fluid; or 3) when the positive fluid pump and negative fluid pump at the two ends of the same fluid channel of the two fluid channels to assist the pump in the same direction and to alternately change the flowing direction. As shown in FIG. 21, at least four bi-directional fluid pumps are installed, wherein two of the bi-directional fluid pumps are installed at the fluid ports (a), (b) of two ends of the first fluid circuit of the heat exchange device, while the other two of the bi-directional fluid pumps are installed at the fluid ports (c), (d) of two ends of the second fluid circuit.

Figure 22:
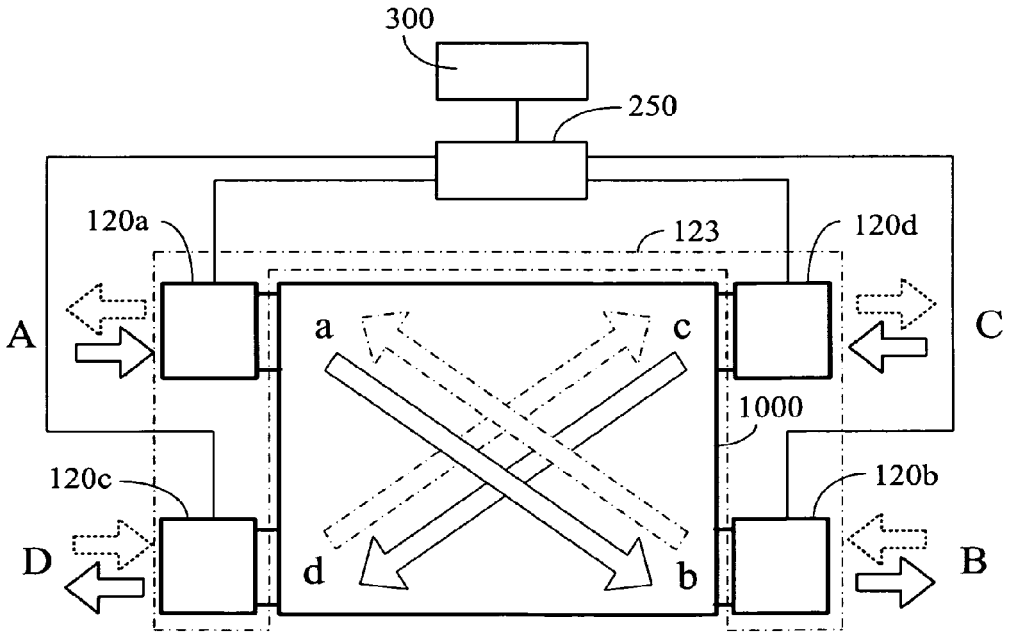
FIG. 22 is the embodied schematic view of the present invention showing that at least four unidirectional fluid pumps are installed, wherein two of the unidirectional fluid pumps are installed at the fluid ports (a), (b) of two ends of the first fluid circuit of the heat exchange device, while the other two of the bi-directional fluid pumps are installed at the fluid ports (c), (d) of two ends of the second fluid circuit.

3. Having at least four unidirectional fluid pumps (120*a*), (120*b*), (120*c*), (120*d*), wherein two unidirectional fluid pumps (120*a*), (120*b*) are separately installed at fluid ports (a), (b) on the two ends of the first fluid circuit of the heat exchange device (1000), while the other two unidirectional fluid pumps (120*c*), (120*d*) are separately installed at fluid ports (c), (d) on the two ends of the second fluid circuit, whereby the at least four unidirectional fluid pumps are controlled by the periodic fluid direction-change operative control device (250) to provide one or multiple of the following operating functions, including: 1) the arrangement of the unidirectional pumps for negative pressure pumping on fluids, wherein the unidirectional pump (120*a*) and unidirectional pump (120*c*) form one set, and the unidirectional pump (120*b*) and unidirectional pump (120*d*) form the other set, so that the two sets alternately provide periodic negative pressure pumping to make the fluids with different flowing direction in two channels change their flowing direction periodically; or 2) the arrangement of unidirectional pumps for positive pressure pumping on fluids, wherein the unidirectional pump (120*a*) and unidirectional pump (120*c*) form one set, and the unidirectional pump (120*b*) and unidirectional pump (120*d*) form the other set, so that the two sets alternately provide periodic positive pressure pumping to change the flowing direction of the fluids in the two channels periodically. As shown in FIG. 22, at least four unidirectional fluid pumps are installed, wherein two of the unidirectional fluid pumps are installed at the fluid ports (a), (b) of two ends of the first fluid circuit of the heat exchange device, while the other two of the bi-directional fluid pumps are installed at the fluid ports (c), (d) of two ends of the second fluid circuit.

The aforementioned fluid pumping devices are provided for pumping gaseous or liquid fluids, wherein the fluid pumps can be driven by a standalone electric motor or at least two fluid pumps can jointly be driven by a single electric motor, the fluid pumps can be driven by engine power, or the mechanical or electric power generated or converted from other wind energy, thermal energy, temperature difference energy or solar energy.

Said periodic fluid direction-change operative control device (250) of the double flow-circuit heat exchange device for periodic positive and reverse directional pumping of the present invention is equipped with an electric motor, or controllable engine power, or mechanical or electric power generated or converted from other wind energy, thermal energy, temperature-difference energy, or solar energy for controlling various fluid pumps for driven, or controlling the operation timing of the fluid pumps or fluid valves, thereby changing the direction of the two circuits passing through the heat exchanger (100) and further to operatively control partial or all regulations of rotational speed, flow rate, fluid pressure of various fluid pumps thereof.

For the aforementioned double flow-circuit heat exchange device for periodic positive and reverse directional pumping, the periodic fluid direction-change operative control device (250) can manipulate the flow rate of the fluid pumped by the bi-directional pumping device (123), wherein the operational modes include one or more of the following modes:

1) the flow rate of pumping fluid is adjusted or set manually;
2) the flow rate of fluid is operatively controlled by referring to the detected signal of the at least one temperature detecting device;
3) the flow rate of fluid is operatively controlled by referring to the detected signal of the at least one moisture detecting device;
4) the flow rate of fluid is operatively controlled by referring to the detected signal of the at least one gaseous or liquid fluid composition detecting device;
5) the flow rate of the fluid is jointly operatively controlled by two or more than two said 1)~4) items.

The double flow-circuit heat exchange device for periodic positive and reverse directional pumping when installed with the function of operatively controlling the flow rate, the flow rate range of the controlled fluid is between stop delivery to the maximum delivering volume, and the flow rate of fluid is manipulated in a stepped or stepless control according to the operational requirements. The flow rate of fluid can also be changed by:

1) operatively controlling the rotational speed during the pumping operation of the bi-directional pumping device (123) from idling to the maximum speed range, thereby to further operatively control the flow rate of fluid;
2) configuring the bi-directional pumping device (123) with controllable fluid valve inlet/outlet to operatively control the open volume of the fluid valve inlet/outlet of the bi-directional pumping device (123), thereby to further operatively control the flow rate of fluid;
3) configuring the unidirectional valve (126) with controllable fluid valve inlet/outlet to operatively control the open volume of the fluid valve inlet/outlet of the unidirectional valve (126), thereby to further operatively control the flow rate of fluid;
4) configuring the fluid valve (129) and fluid valve (129') with controllable fluid valve inlet/outlet to operatively control the open volume of the fluid valve inlet/outlet of the fluid valve (129) and fluid valve (129'), thereby to further operatively control the flow rate of fluid;
5) operatively controlling at least one of the devices in item 1)~4) to intermittingly pump fluid, thereby to modulate the average flow rate by the time ratio of pumping and stop pumping.

For the aforementioned double flow-circuit heat exchange device for periodic positive and reverse directional pumping of the present invention, the flow rate ratio of the two flow circuits passing through the heat exchange device (1000) during the operation can be one or more of the following ratio modes:

1) In the operation of periodically positive and reverse directional pumping fluid, the flow rate of one flow circuit is greater than that of the other flow circuit;
2) In the operation of periodically positive and reverse directional pumping fluid, the flow rate of the two flow circuits are the same;
3) In the operation of periodically positive and reverse directional pumping fluid, when operation in one direction, the flow rate of the two flow circuits are different, while operation in the other direction, the flow rate of the two flow circuits are the same.

For the aforementioned double flow-circuit heat exchange device for periodic positive and reverse directional pumping of the present invention, in the operation of periodically positive and reverse directional pumping fluid, the pumping periodic mode includes one or more of the following:

1) In the operation of periodically positive and reverse directional pumping fluid, the operational time of positive direction and reverse direction are the same;
2) In the operation of periodically positive and reverse directional pumping fluid, the operational time of positive direction and reverse direction are different;
3) The mixed mode of both item 1) and 2).

For the aforementioned double flow-circuit heat exchange device for periodic positive and reverse directional pumping of the present invention, except for the function of periodically positive and reverse directional pumping operation, it further simultaneously has one or more of the following special operational modes:

1) The fluid of two flow circuits pump in fluid in the same flowing direction;
2) The fluid of two flow circuits reversely pump out fluid in the same flowing direction;
3) The fluid of two flow circuits execute periodically positive and reverse directional pumping operation by pumping in fluid and reversely pumping out fluid in the same flowing direction.

The function of the same directional pumping of the aforementioned two flow circuits can be applied to emergently increase the flow rate of fluid pumping in or pumping out.

For the double flow-circuit heat exchange device for periodic positive and reverse directional pumping, during the operation of the flow direction change, to mitigate the impact generated by the gaseous or liquid state fluid in the course of reversing the pumping direction, including the liquid hammer effect generated when the pumping liquid state fluid is reversed, one or more of the following operational methods can be further added to the operational modes of the flow direction change control:

1) In the operation of fluid flow direction change, it is through the operatively control of the fluid pump or fluid valve to slowly reduce the flow rate of fluid, then to be switched to slowly increase the flow rate of fluid to a maximum preset value in the other flow direction;
2) In the operation of fluid flow direction change, it is through the operatively control of the fluid pump or fluid valve to slowly reduce the flow rate of fluid, and to be switched to stop pumping for a preset time period, then further to be switched to slowly increase the flow rate of fluid to a maximum preset value in the other flow direction.

The invention claimed is:

1. A system for exchanging heat between two flows of fluids in a double flow circuit heat exchange device comprising:

a heat exchange device having a first flow circuit and a second flow circuit being configured to exchange heat between two flows of fluid, said first flow circuit having an inlet and an outlet and said second flow circuit having an inlet and an outlet, wherein the inlet of the first flow circuit has a first fluid port, the inlet of the second flow circuit has a second fluid port, the outlet of the first flow circuit has a third fluid port, and the outlet of the second flow circuit has a fourth fluid port;

a plurality of unidirectional fluid pumps coupled to the heat exchange device, each of said plurality of unidirectional fluid pumps configured to pump a fluid, wherein a first fluid pump is coupled to the first fluid port, a second fluid pump is coupled to the second fluid port, a third fluid pump is coupled to the third fluid port, and a fourth fluid pump is coupled to the fourth fluid port;

a power source configured to provide power to each of the plurality of unidirectional fluid pumps;

a periodic fluid direction-change operative control device configured to control operation of each of the plurality of unidirectional fluid pumps;

wherein the plurality of unidirectional fluid pumps are arranged on the respective ports of the first and second flow circuits so that the periodic fluid direction-change operative control device is operable to periodically change a fluid flow direction of a first fluid in the first flow circuit and a fluid flow direction of a second fluid in the second flow circuit.

2. The system for exchanging heat between two fluids in a double flow circuit heat exchange device as claimed in claim 1, wherein the heat exchange device is a heat exchanger having two internal flow paths with heat absorbing and releasing and humidity absorbing and releasing capability, wherein a first flow path is coupled to the first and third fluid ports and a second flow path is coupled to the second and fourth fluid ports of the respective first and second flow circuits.

3. The system for exchanging heat between two fluids in a double flow circuit heat exchange device as claimed in claim 1, wherein the periodic fluid direction-change operative control device is configured to provide one or more of the following operating functions:

the plurality of unidirectional pumps are configured to pump the fluids using negative pressure, wherein the first and third unidirectional pumps on the first flow circuit form a first set of pumps, and the second and fourth unidirectional pumps on the second flow circuit form a second set of pumps, wherein the first and second sets of fluid pumps are configured to produce periodic negative pressure to pump the fluids in different flow directions;

or the plurality of unidirectional pumps are configured to pump the fluids using positive pressure, wherein the first and third unidirectional pumps on the first flow circuit form a first set of pumps, and the second and fourth unidirectional pumps on the second flow circuit form a second set of fluid pumps, wherein the first and second sets of fluid pumps are configured to produce periodic positive pressure to pump the fluids in different flow directions.

4. The system for exchanging heat between two fluids in a double flow circuit heat exchange device as claimed in claim 1, wherein when the periodic fluid direction-change operative control device changes the fluid flow direction, the periodic fluid direction-change operative control device is configured to change a flow rate of the fluid flow between no flow and maximum fluid flow in a stepped operation by controlling the rotational speed of the plurality of fluid pumps from idling to the maximum speed range.

5. The system for exchanging heat between two fluids in a double flow circuit heat exchange device as claimed in claim 1, wherein when the periodic fluid direction-change operative control device changes the fluid flow direction, the periodic fluid direction-change operative control device is configured to change a flow rate of the fluid flow between no flow and maximum fluid flow in a step-less operation by controlling the rotational speed of the plurality of fluid pumps from idling to the maximum speed range.

6. The system for exchanging heat between two fluids in a double flow circuit heat exchange device as claimed in claim 1, wherein the periodic fluid direction-change operative control device is configured to control a flow rate of the first fluid in the first flow circuit and a flow rate of the second fluid in the second flow circuit relatively proportioned according to at least one of the following operational modes:

the fluid flow rate of the first fluid in the first flow circuit is greater than flow rate of the second fluid in the second flow circuit;

the fluid flow rate of the first and second fluid in the first and second flow circuits are the same; and when the plurality of unidirectional fluid pumps are configured to pump the fluid in one direction, the fluid flow rate of the first and second fluid in the first and second flow circuits are different, but when the fluid flow direction changes, the fluid flow rate of the first and second fluids in the first and second flow circuits are the same.

7. The system for exchanging heat between two fluids in a double flow circuit heat exchange device as claimed in claim 1, wherein the periodic fluid direction-change operative control device is configured so that the periodic change of the fluid flow is according to at least one of the following modes:

the operational time for pumping the first fluid in a first fluid flow direction and pumping the second fluid in a second fluid flow direction are the same; and the operational time for pumping the first and second fluids in a first fluid flow direction and a second fluid flow direction are different.

8. The system for exchanging heat between two fluids in a double flow circuit heat exchange device as claimed in claim 1, wherein the periodic fluid direction-change operative control device is further configured to simultaneously operate in at least one of the following special operational modes:

pumping the first and second fluids in the first and second flow circuits are pumped in the same flowing direction;

reversely pumping the first and second fluids out of the first and second flow circuits in the same flowing direction; and positively and reversely pumping the first and second fluids in the first and second flow circuits in the same flowing direction.

9. The system for exchanging heat between two fluids in a double flow circuit heat exchange device as claimed in claim 1, wherein the periodic fluid direction-change operative control device is further configured to mitigate the impact generated by a gaseous or liquid fluid by operating in at least one of the following operational methods:

when changing the fluid flow direction, the periodic fluid direction-change operative control device is configured to control the plurality of unidirectional fluid pumps so that the flow of fluid slowly reduces to no flow and then switches the direction of the fluid flow and slowly increases the flow rate of the fluid to a maximum preset value; and when changing the fluid flow direction, the periodic fluid direction-change operative control device is configured to control the plurality of unidirectional fluid pumps so that the flow of fluid slowly reduces to no flow, and the plurality of pumps are stopped for a preset time period, and then after the plurality of pumps are switched to pump the fluid in a different direction to slowly increase the flow rate of fluid to a maximum preset value.

10. The system for exchanging heat between two fluids in a double flow circuit heat exchange device as claimed in claim 1, further comprising a temperature detecting device; and at least one of a humidity detecting device and a gaseous or liquid state detecting device, installed at positions capable of directly or indirectly detecting the humidity variation or gaseous and liquid fluid composition variation of the pumping fluid respectively.

11. The system for exchanging heat between two fluids in a double flow circuit heat exchange device as claimed in claim 10, wherein the periodic fluid direction-change operative control device is configured to control the fluid flow direction by manipulating a flow rate each of the flows of fluid in one or more of the following operational modes:

the flow rate of pumping fluid is manually adjustable;

the flow rate of fluid is operatively controlled when a detected signal of the at least one temperature detecting device reaches a set value;

the flow rate of fluid is operatively controlled when a detected signal of the at least one moisture detecting device reaches a set value; and the flow rate of fluid is operatively controlled when a detected signal of the at least one gaseous or liquid composition detecting device reaches a set value.

* * * * *